US008529012B2

(12) United States Patent
Yorimoto et al.

(10) Patent No.: US 8,529,012 B2
(45) **Date of Patent: *Sep. 10, 2013**

(54) IMAGE FORMING APPARATUS AND METHOD FOR CORRECTING LANDING POSITIONS OF LIQUID DROPLETS

(75) Inventors: Mamoru Yorimoto, Tokyo (JP); Ichiro Komuro, Kanagawa (JP); Shinichiro Naruse, Kanagawa (JP); Soichi Saiga, Tokyo (JP); Ryusuke Mase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 321 days.

This patent is subject to a terminal disclaimer.

(21) Appl. No.: 13/037,848

(22) Filed: Mar. 1, 2011

(65) Prior Publication Data

US 2011/0216113 A1 Sep. 8, 2011

(30) Foreign Application Priority Data

Mar. 2, 2010 (JP) ..... 2010-045337

(51) Int. Cl.
*B41J 29/393* (2006.01)

(52) U.S. Cl.
USPC ..... 347/19

(58) Field of Classification Search
CPC ..... B41J 2/165
USPC ..... 347/9, 12, 14, 15, 19
See application file for complete search history.

(56) References Cited

U.S. PATENT DOCUMENTS

| | | | |
|---|---|---|---|
| 7,841,682 | B2 | 11/2010 | Yorimoto et al. |
| 7,854,489 | B2 | 12/2010 | Hagiwara et al. |
| 2008/0225066 | A1 | 9/2008 | Yorimoto et al. |
| 2008/0225067 | A1 | 9/2008 | Morino et al. |
| 2008/0225068 | A1 | 9/2008 | Morino et al. |
| 2008/0225098 | A1 | 9/2008 | Hagiwara et al. |
| 2008/0231649 | A1 | 9/2008 | Kawabata et al. |
| 2009/0148181 | A1 | 6/2009 | Niihara et al. |
| 2009/0189937 | A1 | 7/2009 | Naruse et al. |
| 2010/0295897 | A1 | 11/2010 | Naruse et al. |

FOREIGN PATENT DOCUMENTS

| | | |
|---|---|---|
| JP | 2785031 | 5/1998 |
| JP | 3251671 | 11/2001 |
| JP | 2009-66900 | 4/2009 |

*Primary Examiner* — An Do
(74) *Attorney, Agent, or Firm* — Cooper & Dunham LLP

(57) ABSTRACT

An image forming apparatus including a first carriage having at least two first recording heads, a second carriage separatably dockable with the first carriage, a pattern forming unit to control the at least two first recording heads to form on a recording medium adjustment patterns for correcting a shift in landing positions of liquid droplets ejected from the at least two first recording heads, a pattern detector provided to the first carriage to read the adjustment patterns, and a landing position corrector to correct the shift in the landing positions of the liquid droplets based on a result obtained by the pattern detector. The at least two first recording heads form multiple rows of the adjustment patterns, and the pattern detector successively reads at least two rows of the multiple rows of the adjustment patterns without docking and separation of the first and second carriages.

11 Claims, 35 Drawing Sheets

IMAGE FORMING APPARATUS AND METHOD FOR CORRECTING LANDING POSITIONS OF LIQUID DROPLETS

BACKGROUND

1. Technical Field

This disclosure relates generally to an image forming apparatus, and more particularly, to an image forming apparatus using a recording head including a liquid ejection head that ejects liquid droplets, and a method for correcting landing positions of liquid droplets.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects liquid droplets while moving in a main scanning direction to form an image on the sheet as the sheet is moved in a sub-scanning direction perpendicular to the main scanning direction, and a line-type image forming apparatus equipped with a line-type recording head that ejects liquid droplets and does so without moving to form an image on the sheet as the sheet is moved in the sub-scanning direction.

A maintenance mechanism that maintains performance of the recording head is essential for the image forming apparatus employing the liquid ejection recording method. One of the functions of the maintenance mechanism is to discharge bubbles, foreign substances, coagulated ink, and so forth present in the recording head through nozzles in the recording head in order to prevent irregular ejection of the ink from the nozzles in the recording head.

In addition, a full-color image forming apparatus that forms full-color images using the liquid ejection recording method generally includes two separate recording heads, that is, a recording head that ejects black ink droplets (hereinafter referred to as the first recording head) and a recording head that ejects color ink droplets (hereinafter referred to as the second recording head). In such a full-color image forming apparatus, not only black ink but also color ink is ejected for maintenance of the recording heads even when monochrome printing is performed using only the first recording head, causing a waste of color ink and a concomitant cost increase.

In order to solve those problems, some image forming apparatuses deploy separate carriages for the black and color inks. That is, they include a first carriage mounting a first recording head that ejects black ink droplets and a second carriage mounting a second recording head that ejects color ink droplets. The first and second carriages are separatably dockable with each other.

Meanwhile, there are also image forming apparatuses that correct a timing of ejection of ink droplets from recording heads (hereinafter referred to as an ejection timing) in order to prevent a shift in positions on a sheet to which black and color ink droplets are ejected (hereinafter referred to as landing positions of ink droplets). Specifically, the image forming apparatus forms an adjustment pattern and reads the adjustment pattern using an optical sensor to adjust the ejection timing of the black and color ink droplets, thereby correcting the landing positions of the black and color ink droplets on the sheet and reducing color shift during full-color image formation.

However, because the carriage mounting the recording head scans reciprocally to form images on the sheet for each of outward and homeward scanning movement, a shift in the landing positions of the ink droplets between outward and homeward scanning movement tends to occur especially upon formation of ruled lines in the above-described image forming apparatuses. In addition, in a case in which the first and second carriages respectively mounting the first and second recording heads are docked together to form full-color images, a color shift tends to occur when ink droplets of different colors are superimposed one atop the other to form the full-color images on the sheet.

To solve the above-described problems, an arrangement is often employed in which a test pattern formed on a recording medium or a conveyance belt is read by a sensor installed on a carriage to adjust landing positions of ink droplets ejected from recording heads by, for example, controlling the timing of the ejection of the ink droplets.

It is to be noted that any variation or instability in scanning speed of the carriage adversely affects accuracy in reading of the test pattern using the sensor installed on the carriage. Therefore, it is preferable that the carriage be as heavy as possible to accurately read the test pattern.

In the above-described case in which the two separate carriages dockable with each other are used for full-color image formation, the carriages are docked together to make the carriage having the sensor thereon heavier so that the scanning speed of the carriages is stabilized during reading of the test pattern, thereby accurately reading the test pattern.

However, when the landing positions of the ink droplets are corrected during monochrome image formation, the first carriage needs to be separated from the second carriage, to form monochrome images by scanning only the first carriage. As a result, docking and separation of the first and second carriages must be performed between formation and reading of the test pattern.

In addition, when multiple first recording heads are offset laterally from each other on the first carriage in order to increase productivity during monochrome image formation, the number of times the first and second carriages are separated from and docked with each other for forming and reading the test pattern, respectively, is further increased.

Consequently, a period of time required for docking and separating the carriages with and from each other and moving the carriages to a position where docking and separation of the carriages are performed is increased, thereby extending downtime for adjustment of the landing positions.

SUMMARY

In this disclosure, a novel image forming apparatus including first and second carriages separatably dockable with each other is provided that reduces a number of times the carriages are docked with and separated from each other upon automatic adjustment of landing positions of ink droplets, thereby reducing downtime.

In one illustrative embodiment, an image forming apparatus includes a first carriage movable in a main scanning direction and having at least two first recording heads offset laterally from each other to eject black liquid droplets, a second carriage separatably dockable with the first carriage and having a second recording head to eject color liquid droplets, a pattern forming unit to control the at least two first recording heads to form on a recording medium adjustment patterns for correcting a shift in landing positions of the liquid droplets ejected from the at least two first recording heads, a pattern detector provided to the first carriage to read the adjustment patterns, and a landing position corrector to correct the shift in the landing positions of the liquid droplets. Each of the adjustment patterns includes at least two reference patterns and a measured pattern sandwiched by the two reference patterns aligned in the main scanning direction, and the at least two first recording heads form multiple rows of the adjustment patterns in a sub-scanning direction perpendicular to the main scanning direction. The pattern detector successively reads at least two rows of the multiple rows of the adjustment patterns formed in the sub-scanning direction without docking and separation of the first and second carriages. The landing position corrector determines one of a distance between the measured pattern and at least one of the two reference patterns and a scanning time of the first carriage based on a result obtained by the pattern detector and corrects the shift in the landing positions of the liquid droplets.

Another illustrative embodiment provides a method for correcting a shift in landing positions of liquid droplets ejected from at least two first recording heads mounted on a first carriage movable in a main scanning direction and separatably dockable with a second carriage having a second recording head. The method includes the steps of: forming on a recording medium multiple rows of adjustment patterns in a sub-scanning direction perpendicular to the main scanning direction for correcting the shift in the landing positions of the liquid droplets, each of the adjustment patterns including at least two reference patterns and a measured pattern sandwiched by the two reference patterns aligned in the main scanning direction; reading successively at least two rows of the multiple rows of the adjustment patterns formed in the sub-scanning direction using a pattern detector, without docking and separation of the first and second carriages; determining one of a distance between the measured pattern and at least one of the two reference patterns and a scanning time of the first carriage based on a result obtained by the reading; and correcting the shift in the landing positions of the liquid droplets based on the determined distance or determined scanning time.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
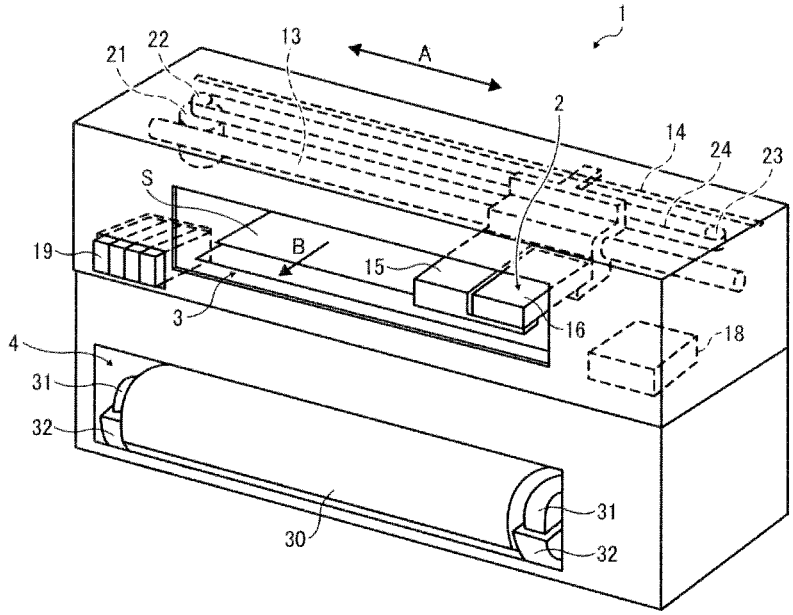
FIG. 1 is a perspective view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns. In addition, ink includes any material which is a liquid when ejected from a recording head, such as a DNA sample, a resist material, and a pattern material. Further, an image formed on the recording medium is not limited to a flat image, but also includes an image formed on a three-dimensional object, a three-dimensional image, and so forth.

Figure 2:
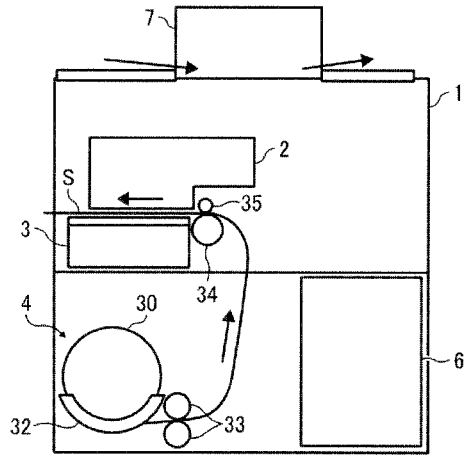
FIG. 2 is a vertical cross-sectional view illustrating the example of the configuration of the image forming apparatus illustrated in FIG. 1.
Figure 3:
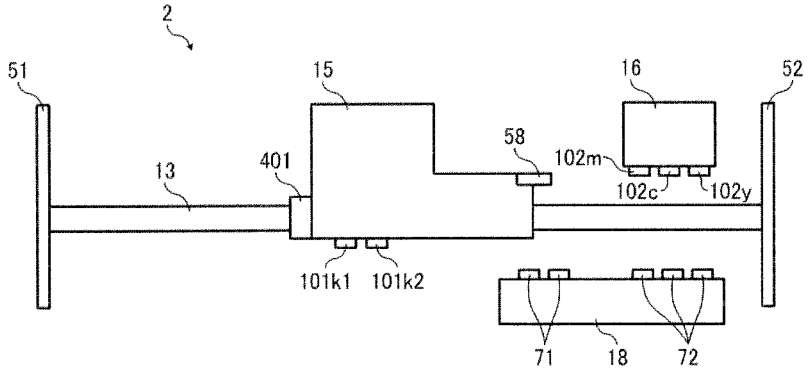
FIG. 3 is a front view illustrating an example of a configuration of an image forming unit of the image forming apparatus illustrated in FIG. 1.

A description is now given of a configuration and operation of an inkjet recording device serving as an image forming apparatus 1 according to illustrative embodiments with reference to FIGS. 1 to 3. FIG. 1 is a perspective view illustrating an example of a configuration of the image forming apparatus 1. FIG. 2 is a vertical cross-sectional view illustrating the configuration of the image forming apparatus 1. FIG. 3 is a front view illustrating an example of a configuration of an image forming unit 2 of the image forming apparatus 1.

The image forming apparatus 1 is a serial-type inkjet recording device, and includes the image forming unit 2, a sheet conveyance unit 3, a sheet roll storage 4, an electrical substrate storage 6, an image reading unit 7 provided at the top thereof, and so forth. It is to be noted that the image reading unit 7 is omitted in FIG. 1 for ease of illustration.

In the image forming unit 2, a guide rod 13 and a guide rail 14 are extended between lateral plates 51 and 52, and a first carriage 15 that ejects black ink droplets is slidably held by the guide rod 13 and the guide rail 14 in a direction indicated by a double-headed arrow A in FIG. 1 (hereinafter referred to as the main scanning direction). A second carriage 16 that ejects color ink droplets can be docked with and separated from the first carriage 15. It is to be noted that FIG. 1 illustrates a state in which the first and second carriages 15 and 16 are docked together, and FIG. 3 illustrates a state in which the first and second carriages 15 and 16 are separated from each other.

A main scanning mechanism that moves the first carriage 15 reciprocally back and forth in the main scanning direction includes a drive motor 21 positioned at one end of the image forming apparatus 1 in the main scanning direction, a drive pulley 22 rotatively driven by the drive motor 21, a driven pulley 23 provided at the other end of the image forming apparatus 1 in the main scanning direction, and a belt member 24 wound around the drive pulley 22 and the driven pulley 23. A tension spring, not shown, applies tension to the driven pulley 23 to separate the driven pulley 23 from the drive pulley 22. A part of the belt member 24 is fixed to a mount provided to a back surface of the first carriage 15 to guide the first carriage 15 in the main scanning direction.

An encoder sheet, not shown, is provided along the main scanning direction in order to detect a main scanning position of the first carriage 15. The encoder sheet is read by an encoder sensor, not shown, provided to the first carriage 15.

The first carriage 15 has a main scanning range through which it scans, and within this range is a recording range. A sheet S fed from a sheet roll 30 is intermittently conveyed to the recording range by the sheet conveyance unit 3 in a direction perpendicular to the main scanning direction as indicated by an arrow B in FIG. 1 (hereinafter referred to as the sub-scanning direction).

An ink cartridge 19 that stores ink of a specific color, that is, magenta (M), cyan (C), yellow (Y), or black (K), to be supplied to sub-tanks included in recording heads provided to the first and second carriages 15 and 16, is detachably attached to the image forming apparatus 1 at the one end of the image forming apparatus 1 in the main scanning direction, that is, a portion outside the main scanning range of the first carriage 15. A maintenance mechanism 18 that services and moisturizes the recording heads using caps 71 and 72 is provided at the other end of the image forming apparatus 1 in the main scanning direction within the main scanning range of the first carriage 15.

The sheet roll 30 is set in the sheet roll storage 4 serving as a sheet feed unit. The sheet roll 30 having different widths can be set in the sheet roll storage 4. Flanges 31 are attached to both ends of a paper core of the sheet roll 30 and are placed on flange bearings 32, respectively. Support rollers, not shown, are provided to the flange bearings 32 to contact outer circumferential surfaces of the flanges 31, respectively, thereby rotating the flanges 31 to feed the sheet S from the sheet roll 30.

The sheet S fed from the sheet roll 30 set in the sheet roll storage 4 is conveyed by conveyance members such as a pair of rollers 33, a drive roller 34, and a driven roller 35 from the back to the front of the image forming apparatus 1 to reach the recording range. In monochrome printing, the first carriage 15 is moved reciprocally in the main scanning direction, and the recording heads of the first carriage 15 are driven to eject black ink droplets onto the sheet S based on image data while the sheet S is intermittently conveyed in the sub-scanning direction. By contrast, in full-color printing, the first and second carriages 15 and 16 are docked together, and the recording heads of the first and second carriages 15 and 16 are together driven to eject ink droplets of the specified color onto the sheet S based on image data. Accordingly, a desired image is formed on the sheet S. The sheet S having the image thereon is then cut to a predetermined length and is discharged to a discharge tray, not shown, provided to the front of the image forming apparatus 1.

Figure 4:
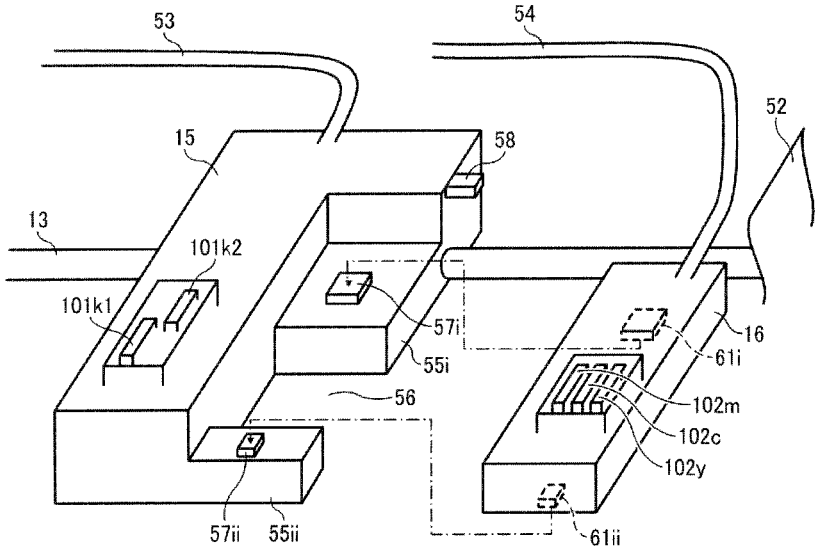
FIG. 4 is a perspective view illustrating an example of a configuration of first and second carriages separated from each other according to illustrative embodiments.
Figure 5:
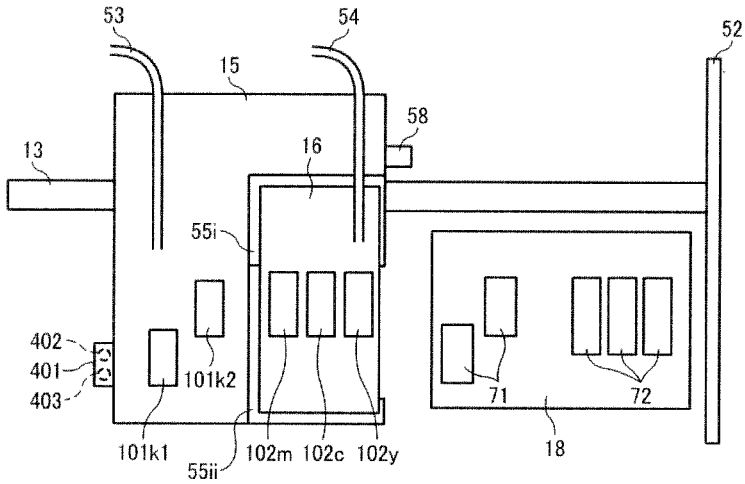
FIG. 5 is a top view illustrating an example of a configuration of the first and second carriages docked with each other according to illustrative embodiments.
Figure 6:
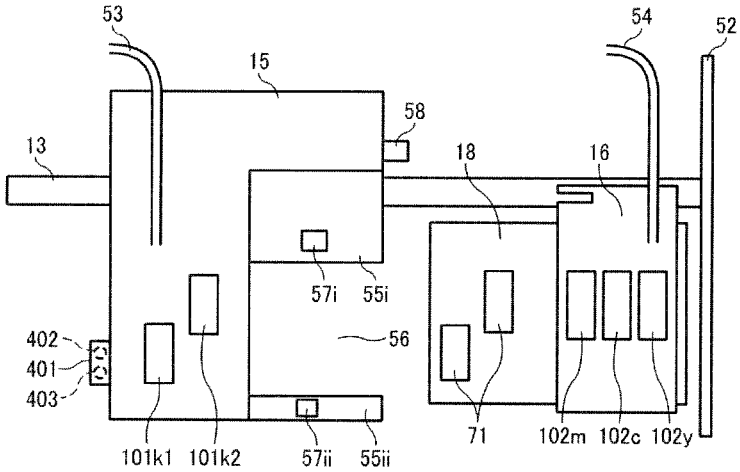
FIG. 6 is a top view illustrating the example of the configuration of the first and second carriages separated from each other.

A description is now given of a configuration of each of the first and second carriages 15 and 16 according to illustrative embodiments with reference to FIGS. 4 to 6. FIG. 4 is a perspective view illustrating an example of a configuration of the first and second carriages 15 and 16 separated from each other according to illustrative embodiments. FIG. 5 is a top view illustrating an example of a configuration of the first and second carriages 15 and 16 docked together. FIG. 6 is a top view illustrating the example of the configuration of the first and second carriages 15 and 16 separated from each other.

The first carriage 15 includes first recording heads **101*k*1 and 101*k*2 (hereinafter collectively referred to as first recording heads 101) each including a liquid ejection head that ejects black ink droplets. The first recording heads 101 are offset laterally from each other in the main scanning direction and the sub-scanning direction on the first carriage 15, and the first carriage 15 is moved reciprocally in the main scanning direction along the guide rod 13 by the main scanning mechanism. Black ink is supplied from the ink cartridge 19 provided to the image forming apparatus 1 to the sub-tanks integrally formed with the first recording heads 101 through a tube 53. Alternatively, replaceable ink cartridges may be attached to the first recording heads 101**.

The second carriage 16 includes second recording heads **102*m*, 102*c*, and 102*y* (hereinafter collectively referred to as second recording heads 102), each including a liquid ejection head that ejects ink droplets of a specific color, that is, magenta (M), cyan (C), or yellow (Y). The second recording heads 102 are positioned at the same position as the first recording head 101*k*2 in the main scanning direction. The second carriage 16 is docked with the first carriage 15 to be moved reciprocally in the main scanning direction together with the first carriage 15 by reciprocating movement of the first carriage 15. Ink of the specified color is supplied from the ink cartridge 19 provided to the image forming apparatus 1 to the sub-tanks integrally formed with the second recording heads 102 through a tube 54. Alternatively, replaceable ink cartridges may be attached to the second recording heads 102**.

The first carriage 15 has mounts **55*i* and 55*ii* (hereinafter collectively referred to as mounts 55) to place the second carriage 16 thereon, and a cutout 56 is formed between the mounts 55. When the second carriage 16 is placed on the mounts 55 to be docked with the first carriage 15, the color ink droplets are ejected from the second recording heads 102 of the second carriage 16 onto the sheet S through the cutout 56, and the caps 72 of the maintenance mechanism 18 are moved up and down within the cutout 56. The mounts 55 respectively have engaging members 57***i* and 57*ii* (hereinafter collectively referred to as engaging members 57) each separatably engageable with engaging members 61*i* and 61*ii* (hereinafter collectively referred to as engaging members 61) provided to the second carriage 16.

The first carriage 15 further includes a protrusion 58 that protrudes toward the lateral plate 52 beyond the second carriage 16 when the first carriage 15 is docked with the second carriage 16. The protrusion 58 is used for detecting a reference position of the first carriage 15. Specifically, a position where the protrusion 58 contacts the lateral plate 52 is detected by, for example, detecting a change in a drive current of the drive motor 21, and the first carriage 15 is moved from that position to a direction opposite the lateral plate 52 by a predetermined amount and the resultant position of the first carriage 15 is set as the reference position. A home position of the first carriage 15 can be detected in a manner similar to detection of the reference position of the first carriage 15 as described above, and may be the same as or different from the reference position.

Alternatively, a detection member may be provided to the first carriage 15 in place of the protrusion 58 so that relative positions of the detection member and a reference position provided to the main body of the image forming apparatus 1 are detected to determine the reference position of the first carriage 15. In such a case, the reference position of the first carriage 15 may be determined by, for example, a reference position detector such as a sensor provided to the main body of the image forming apparatus 1, or by matching of a result detected by the encoder sensor that detects the position of the first carriage 15 and a preset reference position.

A pattern detector 401 serving as a pattern reader that reads an adjustment pattern 400 formed on the sheet S for automatically correcting a shift in positions to where the ink droplets are ejected from the first and second recording heads 101 and 102 onto the sheet S (hereinafter referred to as landing positions) is provided on a lateral surface of the first carriage 15. The pattern detector 401 is an optical sensor including a reflective-type photosensor. Specifically, the pattern detector 401 includes a light emitter 402 that emits light onto the adjustment pattern 400 and a light receiver 403 that receives light reflected from the adjustment pattern 400.

Figure 7:
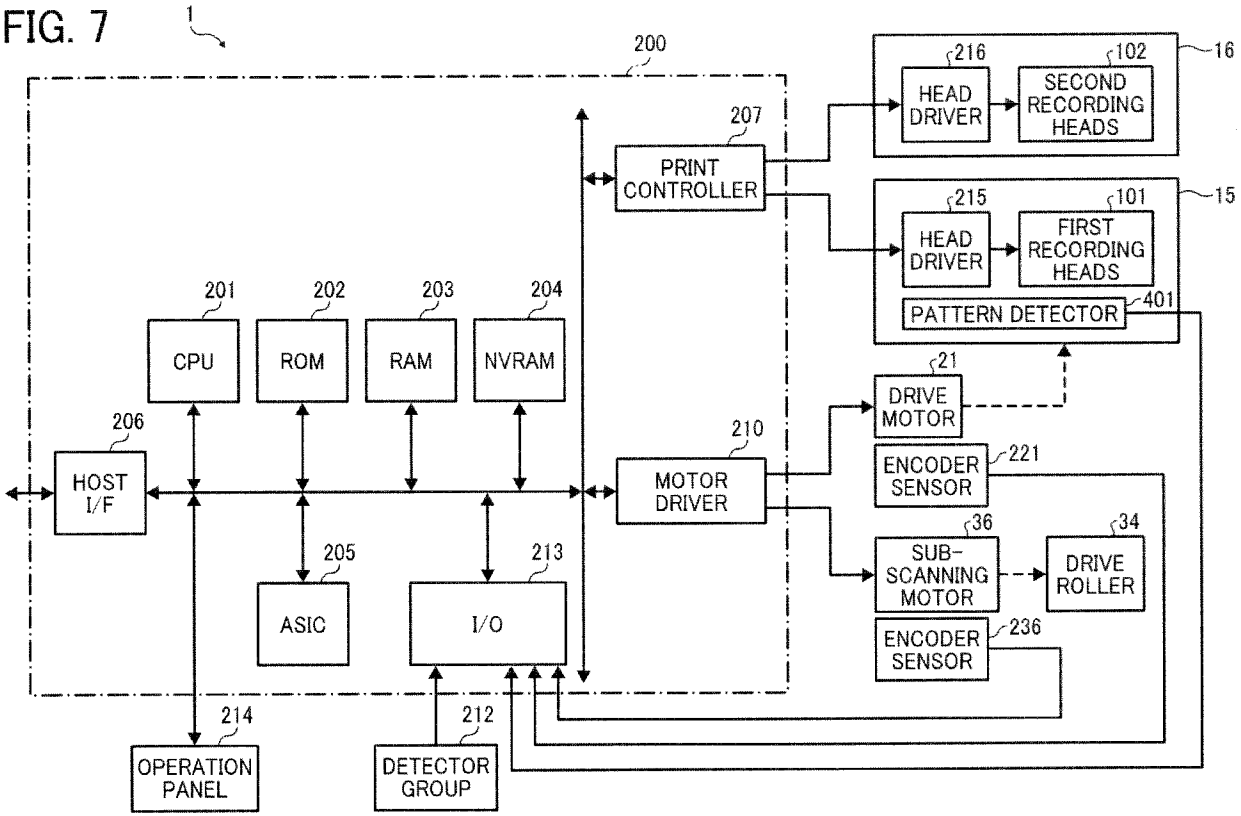
FIG. 7 is a block diagram illustrating an example of a configuration and operation of a control unit of the image forming apparatus according to illustrative embodiments.

A description is now given of an example of a configuration and operation of a control unit 200 of the image forming apparatus 1 according to illustrative embodiments with reference to FIG. 7. FIG. 7 is a block diagram illustrating an example of a configuration and operation of the control unit 200.

The control unit 200 controls the image forming apparatus 1, and includes a CPU 201 serving also as a landing position corrector, a ROM 202 that stores fixed data and various programs including a program for performing processing relating to correction of the landing positions performed by the CPU 201, a RAM 203 that temporarily stores image data and so forth, a nonvolatile rewritable memory (NVRAM) 204 that holds data while power supply to the image forming apparatus 1 is blocked, and an ASIC 205 that performs signal processing for image data and image processing such as sorting of the image data and handles input/output signals for controlling the image forming apparatus 1.

The control unit 200 further includes a host I/F 206 that sends and receives data and signals to and from a host; a print controller 207 including a data transfer unit for controlling driving of the liquid ejection heads, that is, the first and second recording heads 101 and 102, and a drive waveform generator that generates a drive waveform; a motor driver 210 for driving the drive motor 21 and a sub-scanning motor 36 that rotates the drive roller 34; and an I/O 213 that inputs various detection signals output from encoder sensors 221 and 236 and the pattern detector 401 as well as various detection signals output from a detector group 212 including a temperature detector for detecting a surrounding temperature that may cause a shift in the landing positions. An operation panel 214 through which data necessary for the image forming apparatus 1 is input and on which such data is displayed is connected to the control unit 200.

The control unit 200 receives image data and so forth sent from the host including an information processing device such as a personal computer and an image reading device such as an image scanner using the host I/F 206 through a cable or a network, which may be either wired or wireless.

The CPU 201 of the control unit 200 reads image data from a reception buffer included in the host I/F 206 and analyzes the image data so that image processing and sorting of the image data are performed by the ASIC 205 as needed. The resultant image data is transferred from the print controller 207 to a head driver 215 for the first recording heads 101 of the first carriage 15 and a head driver 216 for the second recording heads 102 of the second carriage 16. It is to be noted that dot pattern data for outputting an image on the sheet S is generated by a printer driver provided to the host.

Specifically, the print controller 207 transfers the above-described image data as serial data to the head drivers 215 and 216 and outputs a transfer clock, a clutch signal, a mask signal, and so forth each necessary for transferring the image data and confirming transfer of the image data to the head drivers 215 and 216. As described above, the print controller 207 includes the drive waveform generator having a voltage amplifier, a current amplifier, a D/A converter that performs digital/analog conversion of pattern data of a drive signal stored in the ROM 202, and so forth. The print controller 207 further includes a drive waveform selector that outputs a drive waveform having a single drive pulse or multiple drive pulses generated by the drive waveform generator to the head drivers 215 and 216.

The head drivers 215 and 216 selectively apply the drive signal forming the drive waveform output from the print controller 207 to a drive element such as a piezoelectric element that generates energy to drive the first and second recording heads 101 and 102 to eject the ink droplets based on a single line of the image data serially input to the first and second recording heads 101 and 102. At this time, a size of a dot of the ink droplet ejected from the first and second recording heads 101 and 102 can be changed to small, medium, or large by selecting the drive pulse that forms the drive waveform as appropriate.

The CPU 201 calculates a drive output value (or a control value) for the drive motor 21 based on a speed detection value and a position detection value each obtained by sampling a detection pulse output from the encoder sensor 221, and a target speed value and a target position value obtained from prestored speed and position profiles to drive the drive motor 21 through the motor driver 210. Similarly, the CPU 201 calculates a drive output value (or a control value) for the sub-scanning motor 36 based on a speed detection value and a position detection value each obtained by sampling a detection pulse output from the encoder sensor 236, and a target speed value and a target position value obtained from prestored speed and position profiles to drive the sub-scanning motor 36 through the motor driver 210.

As described previously, the CPU 201 also serves as a landing position corrector. Specifically, the CPU 201 causes the first and second recording heads 101 and 102 to form the adjustment pattern 400 for correcting a shift in the landing positions on the sheet S. The adjustment pattern 400 thus formed is read by the pattern detector 401. The CPU 201 calculates a correction amount to adjust a timing at which the first and second recording heads 101 and 102 eject the ink droplets onto the sheet S (hereinafter referred to as an ejection timing) for image formation based on the result obtained by the pattern detector 401. Thereafter, the CPU 201 sends the correction amount thus calculated to the print controller 207 to correct a shift in the landing positions.

Figure 8:
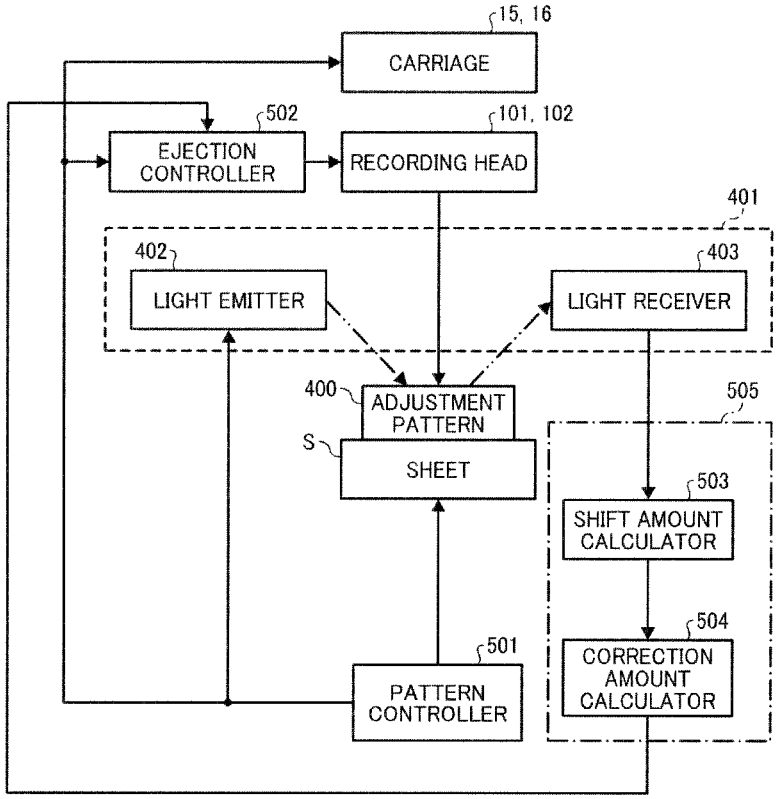
FIG. 8 is a block diagram illustrating an example of a configuration and operation of a shift corrector.
Figure 9:
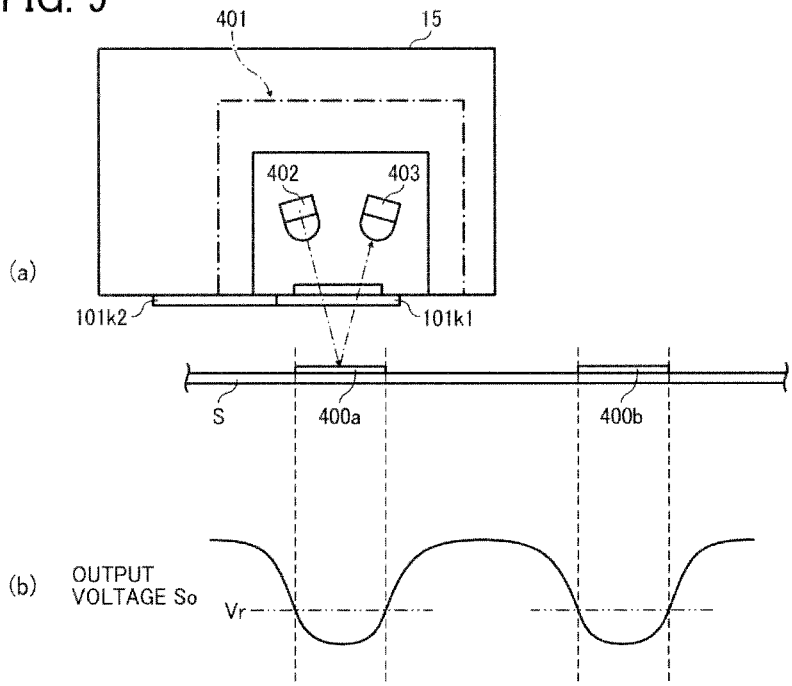
FIGS. 9(*a*) and 9(*b*) are schematic views illustrating operation of correcting a shift in landing positions.
Figure 10:
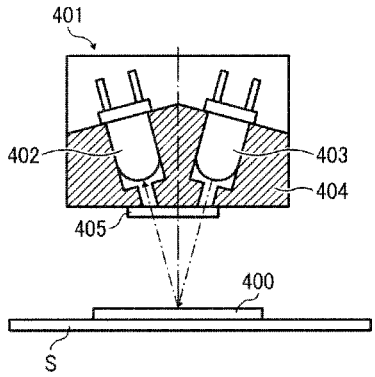
FIG. 10 is a schematic view illustrating an example of a configuration of a pattern detector.

A description is now given of correction of a shift in the landing positions in the image forming apparatus 1 with reference to FIGS. 8 to 10. FIG. 8 is a block diagram illustrating an example of a configuration and operation of a shift corrector 505. FIGS. 9(*a*) and 9(*b*) are schematic views illustrating operation of correcting a shift in the landing positions. FIG. 10 is a schematic view illustrating an example of a configuration of the pattern detector 401.

As described above, the first carriage 15 includes the pattern detector 401 that reads the adjustment pattern 400 formed on the sheet S for correcting a shift in the landing positions. It is to be noted that the adjustment pattern 400 is composed of at least a reference pattern 400*a* and a measured pattern 400*b*.

The pattern detector 401 includes the light emitter 402 that emits light onto the adjustment pattern 400 formed on the sheet S and the light receiver 403 that receives light regularly or diffusively reflected from the adjustment pattern 400. The light emitter 402 and the light receiver 403 are disposed side by side in a direction perpendicular to the main scanning direction, that is, the sub-scanning direction, and are held in a holder 404. The holder 404 has a lens 405 at a portion through which the light is emitted or entered.

As described above, the light emitter 402 and the light receiver 403 are disposed side by side in the sub-scanning direction within the pattern detector 401. Accordingly, a change in scanning speed of the first carriage 15 hardly affects the result detected by the pattern detector 401. A relatively simple and inexpensive light source such as an optical LED may be used as the light emitter 402. Further, an inexpensive lens is used for a spot size of the light source, thereby achieving mm-order detection accuracy.

The image forming apparatus 1 further includes a pattern controller 501 serving as a pattern forming unit that causes the first carriage 15 to move in the main scanning direction and the first and second recording heads 101 and 102 to eject the ink droplets through an ejection controller 502. Accordingly, the adjustment pattern 400 including the reference pattern 400*a* and the measured pattern 400*b* each having a linear shape is formed on the sheet S.

In addition, the pattern controller 501 controls the pattern detector 401 to read the adjustment pattern 400 formed on the sheet S. Specifically, the pattern controller 501 drives the light emitter 402 of the pattern detector 401 to emit light while causing the first carriage 15 to move in the main scanning direction so that the light is emitted from the light emitter 402 to the adjustment pattern 400 formed on the sheet S.

The light emitted from the light emitter 402 to the adjustment pattern 400 is reflected from the adjustment pattern 400 and strikes the light receiver 403. Accordingly, a detection signal is output from the light receiver 403 corresponding to an amount of light reflected from the adjustment pattern 400. The detection signal thus output is then input into a shift amount calculator 503 included in the shift corrector 505.

The shift amount calculator 503 obtains a time interval between each of the reference patterns 400*a* and a time interval between the reference pattern 400*a* and the measured patterns 400*b* based on the result output from the light receiver 403. In addition, the shift amount calculator 503 obtains a distance between each of the reference patterns 400*a* based on the scanning speed of the first carriage 15. Then, the shift amount calculator 503 calculates a distance between the reference pattern 400*a* and the measured patterns 400*b* and corrects the distance thus calculated based on the distance between each of the reference patterns 400*a* and a theoretical distance between each of the reference patterns 400*a* (or a scanning time of the first carriage 15). As a result, an amount of shift of the measured pattern 400*b* from the reference position, that is, an amount of shift in the landing positions, is calculated.

The amount of shift in the landing positions calculated by the shift amount calculator 503 is then sent to a correction amount calculator 504. The correction amount calculator 504 calculates a correction amount that adjusts a timing at which the ejection controller 502 drives at least one of the first and second recording heads 101 and 102 to eject the ink droplets onto the sheet S, such that the amount of shift in the landing positions is eliminated. The correction amount thus calculated is set to the ejection controller 502. Accordingly, the ejection controller 502 adjusts the ejection timing based on the correction amount and appropriately drives at least one of the first and second recording heads 101 and 102, thereby preventing a shift in the landing positions.

Figure 11:
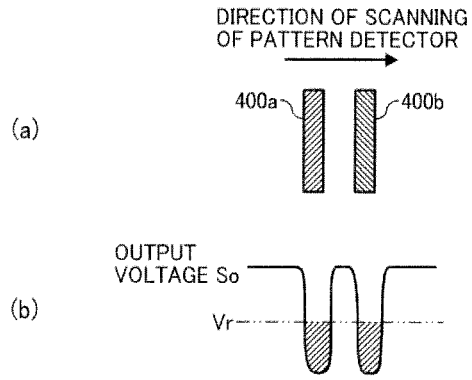
FIGS. 11(*a*) and 11(*b*) are schematic views illustrating a first example of detection of an adjustment pattern.
Figure 12A:
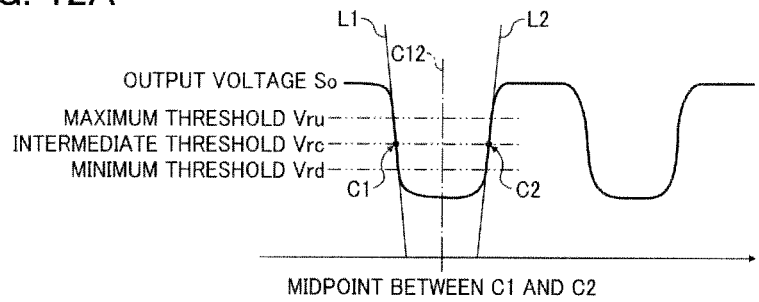
FIG. 12A is a graph illustrating an output voltage obtained by scanning the pattern detector on the adjustment pattern in a second example of detection of the adjustment pattern.
Figure 12B:
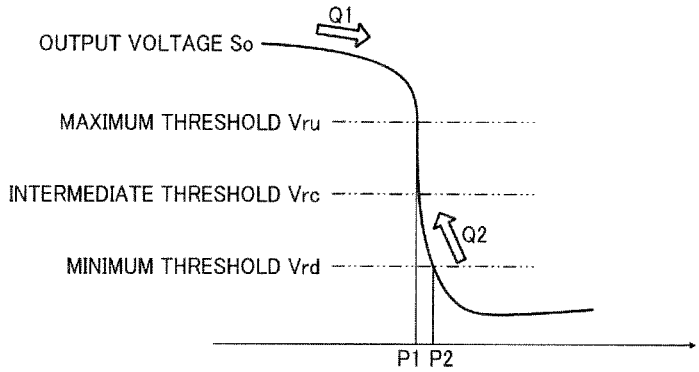
FIG. 12B is an enlarged graph illustrating a portion at a falling edge of the output voltage illustrated in FIG. 12A.
Figure 13:
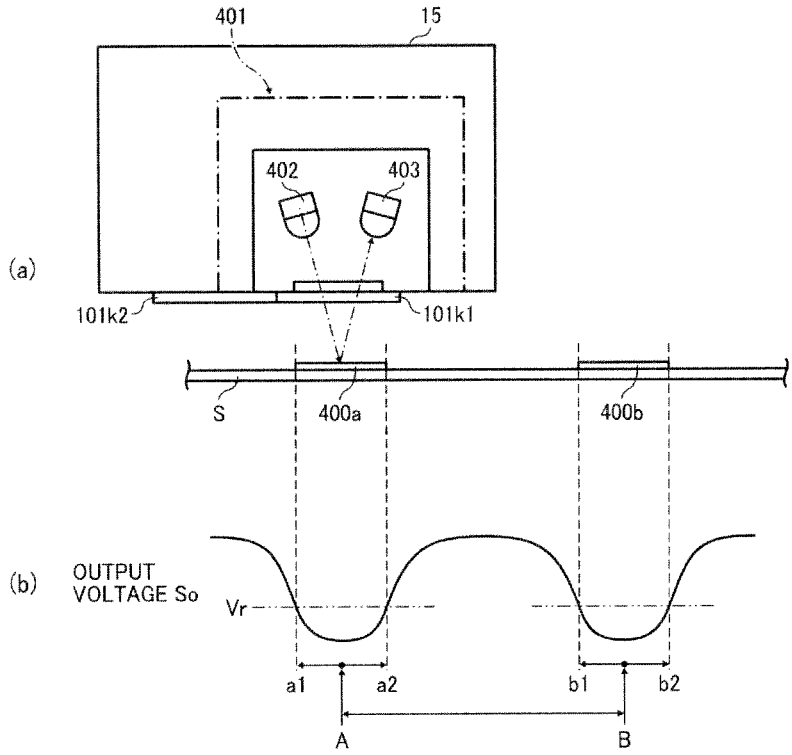
FIGS. 13(*a*) and 13(*b*) are schematic views illustrating a third example of detection of the adjustment pattern.

A description is now given of examples of detection of the adjustment pattern 400 formed on the sheet S and calculation of a distance between the reference pattern 400*a* and the measured pattern 400*b* with reference to FIGS. 11 to 13. FIGS. 11(*a*) and 11(*b*) are schematic views illustrating a first example of detection of the adjustment pattern 400. FIG. 12A is a graph illustrating an output voltage So obtained by scanning the pattern detector 401 on the adjustment pattern 400 in a second example of detection of the adjustment pattern 400. FIG. 12B is an enlarged graph illustrating a portion at a falling edge of the output voltage So illustrated in FIG. 12A. FIGS. 13(*a*) and 13(*b*) are schematic views illustrating a third example of detection of the adjustment pattern 400.

In the example illustrated in FIG. 11(*a*), the pattern detector 401 scans in the main scanning direction to read the reference pattern 400*a* and the measured pattern 400*b* of the adjustment pattern 400 formed on the sheet S. Accordingly, an output voltage So that falls upon detection of the reference pattern 400*a* and the measured pattern 400*b* as illustrated in FIG. 11(*b*) is obtained from a result output from the light receiver 403 of the pattern detector 401.

The output voltage So is compared to a predetermined threshold Vr to detect an edge of the reference pattern 400*a* and the measured pattern 400*b*, that is, a position in which the output voltage So falls below the threshold Vr. At this time, a center of gravity of a range defined by the threshold Vr and the output voltage So, that is, a shaded parts in the graph shown in FIG. 11(*b*), is calculated to use the center of gravity of the range thus calculated as the center of the reference pattern 400*a* and the measured pattern 400*b*. Accordingly, an error caused by minute fluctuation in the output voltage So can be reduced.

In the second example, the pattern detector 401 scans on the adjustment pattern 400 formed on the sheet S so that an output voltage So illustrated in FIG. 12A is obtained.

The portion at the falling edge of the output voltage So is searched in a direction indicated by an arrow Q1 in FIG. 12B, and a point where the output voltage So falls below a minimum threshold Vrd is stored as a point P2. Next, the output voltage So is searched from the point P2 in a direction indicated by an arrow Q2 in FIG. 12B, and a point where the output voltage So exceeds a maximum threshold Vru is stored as a point P1. Then, a regression line L1 is calculated from the output voltage So between the points P1 and P2, and an intersection point C1 of the regression line L1 and an intermediate threshold Vrc between the maximum and minimum thresholds Vru and Vrd is calculated using the regression line L1 thus obtained. Similarly, a regression line L2 at a portion at a rising edge of the output voltage So is calculated to calculate an intersection point C2 of the regression line L2 and the intermediate threshold Vrc. Thereafter, a midpoint between the intersection points C1 and C2 (C1+C2/2) is calculated to obtain a line center C12.

In the third example, the pattern detector 401 scans in the main scanning direction to read the reference pattern 400*a* and the measured pattern 400*b* respectively formed on the sheet S as illustrated in FIG. 13(*a*). Accordingly, an output voltage So shown in FIG. 13(*b*) is obtained.

At this time, for example, harmonic noises are removed using an IIR filter, and then quality of detection signals is evaluated. Next, a sloped portion near the threshold Vr is detected to calculate a regression line. Thereafter, intersection points a1, a2, b1, and b2 of the regression line and the threshold Vr are calculated to calculate a midpoint A between the intersection points a1 and a2 and a midpoint B between the intersection points b1 and b2, respectively.

Figure 14:
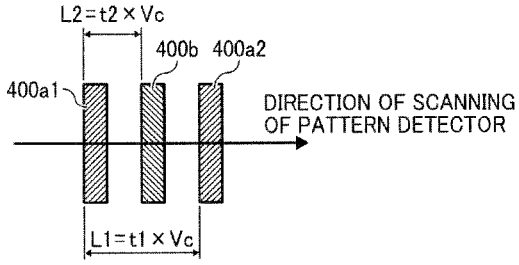
FIG. 14 is a schematic view illustrating an example of a basic configuration of the adjustment pattern.
Figure 15A:
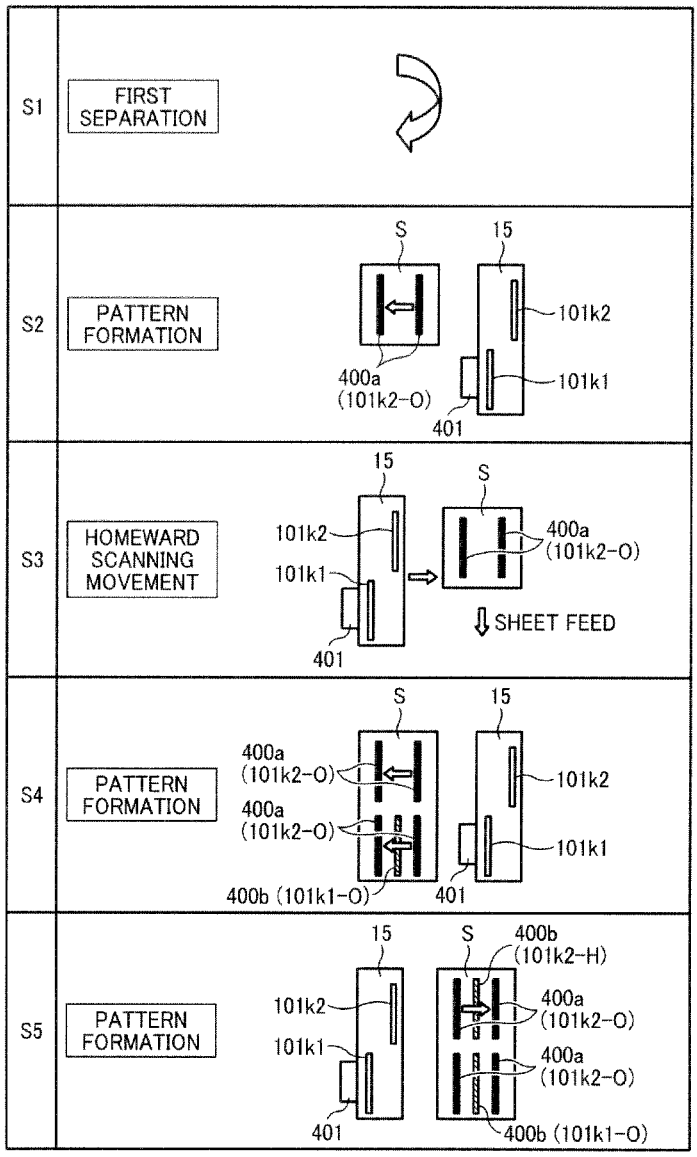
FIGS. 15A to 15D are explanatory drawings illustrating steps in a process of formation and reading of the adjustment pattern according to a first illustrative embodiment.
Figure 15B:
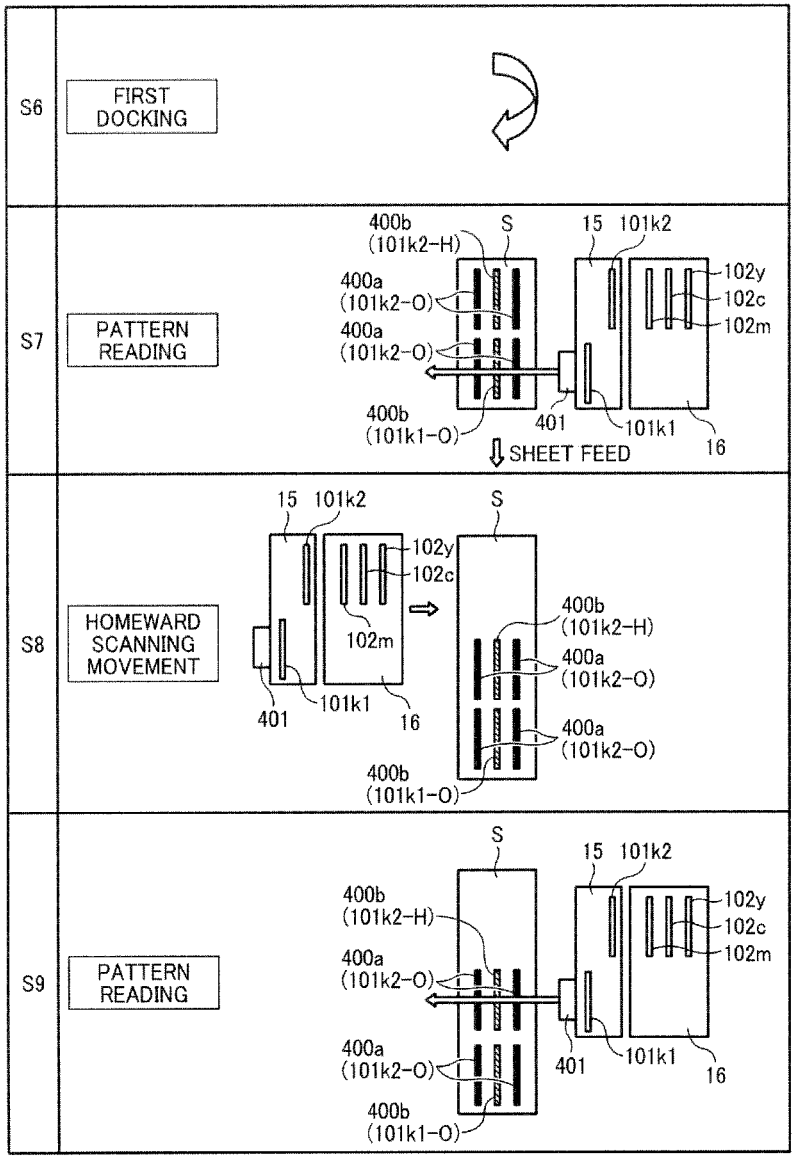
Figure 15C:
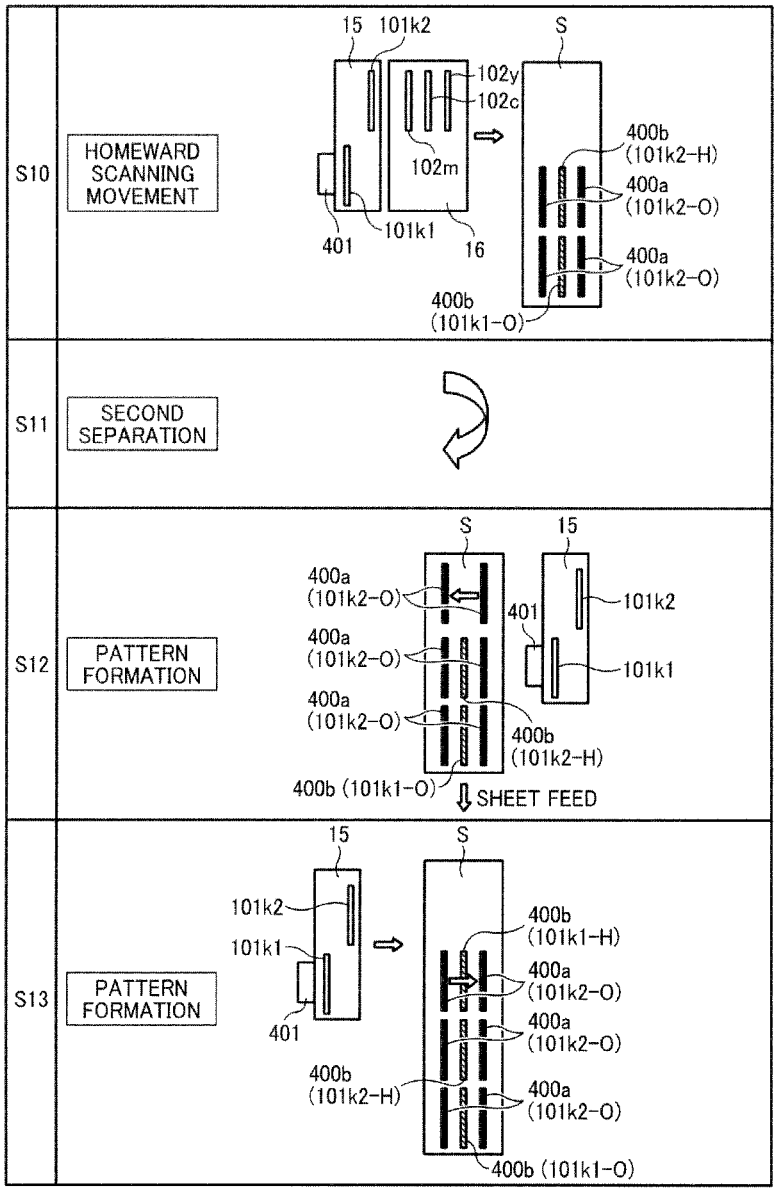
Figure 15D:
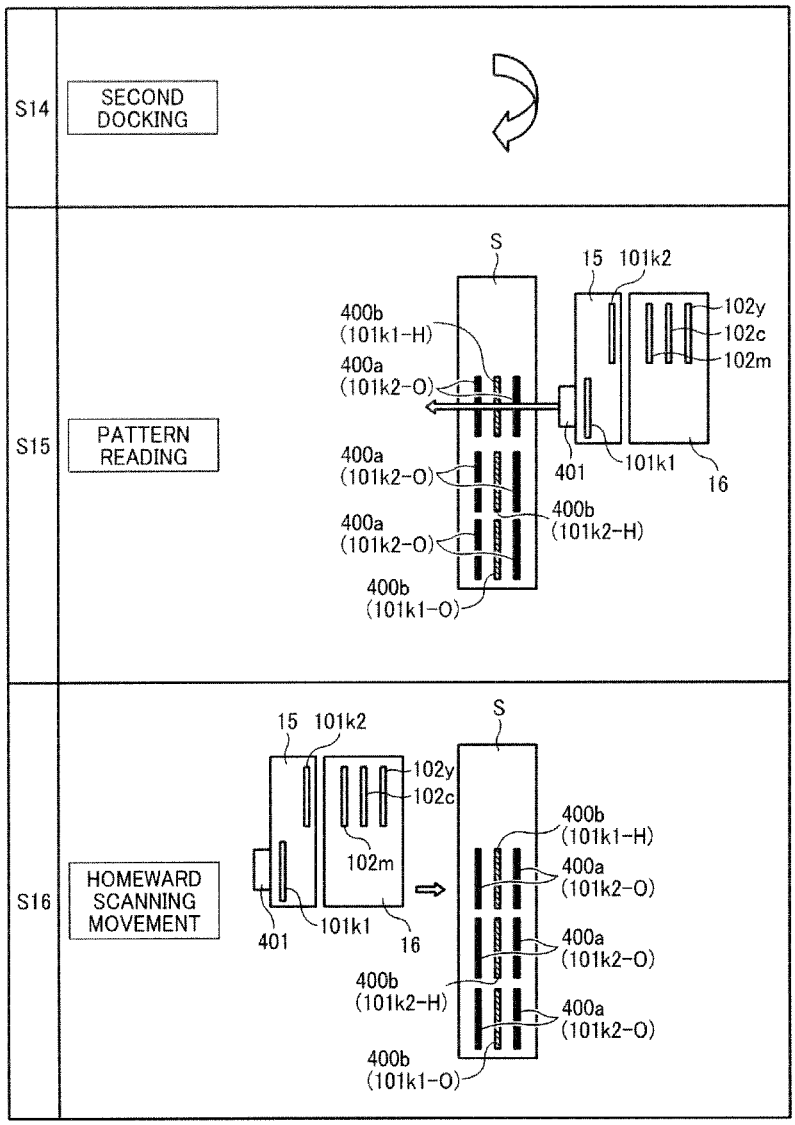
Figure 16A:
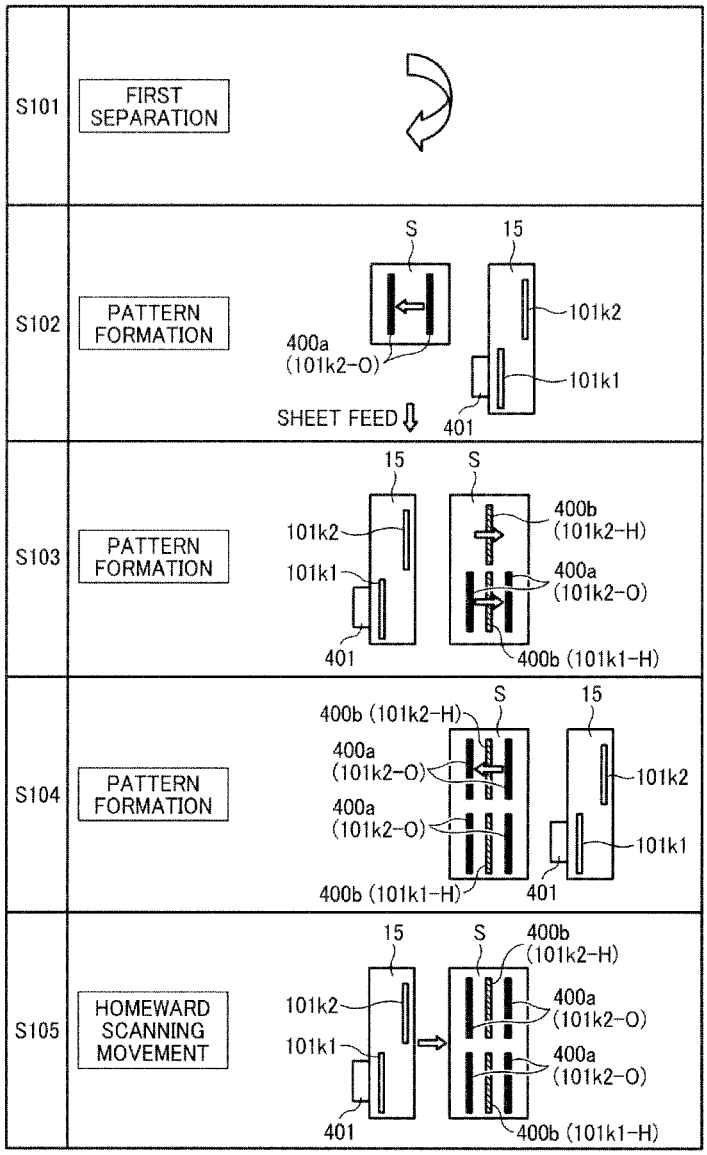
FIGS. 16A to 16E are explanatory drawings illustrating steps in a process of formation and reading of the adjustment pattern according to a second illustrative embodiment.
Figure 16B:
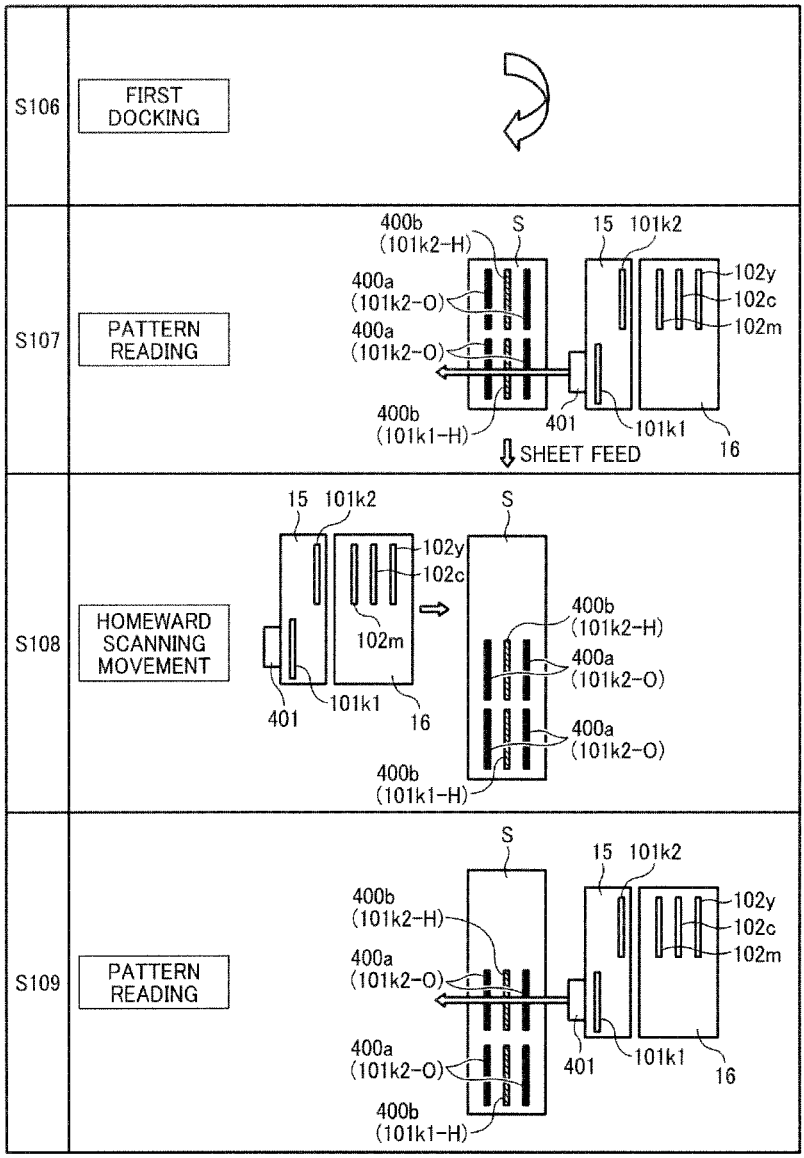
Figure 16C:
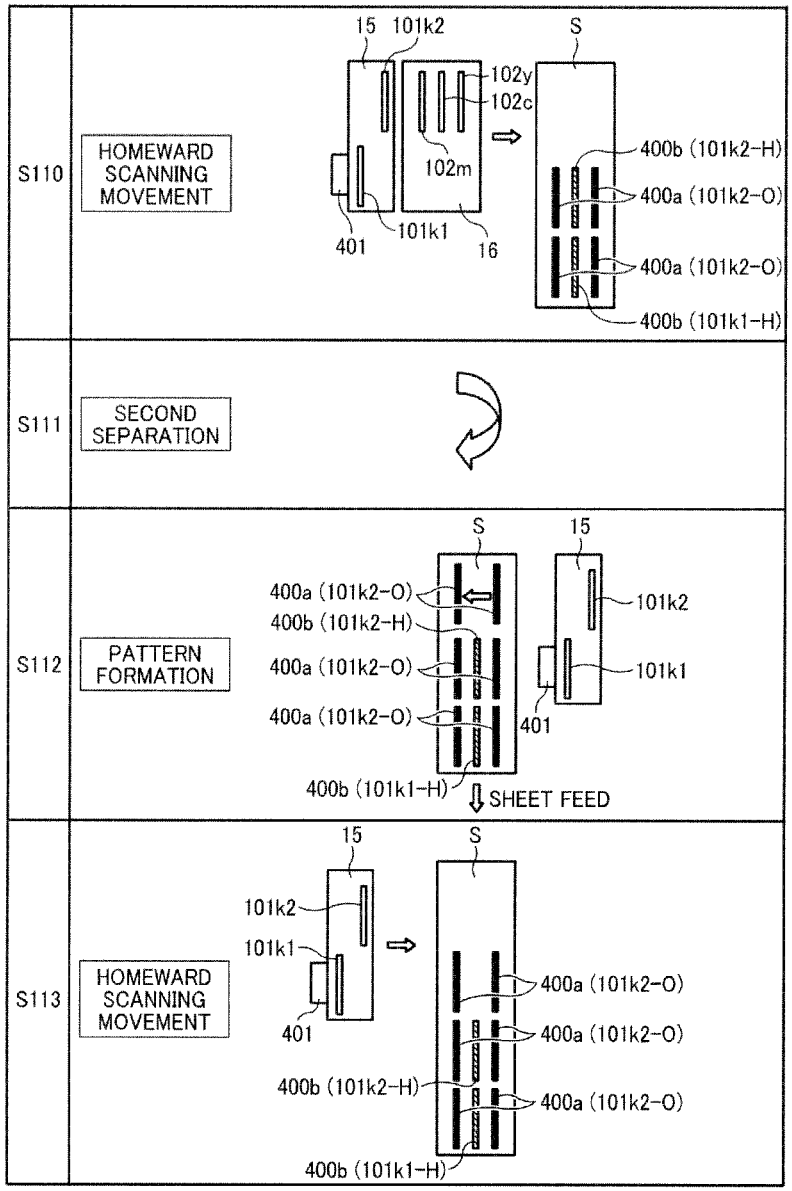
Figure 16D:
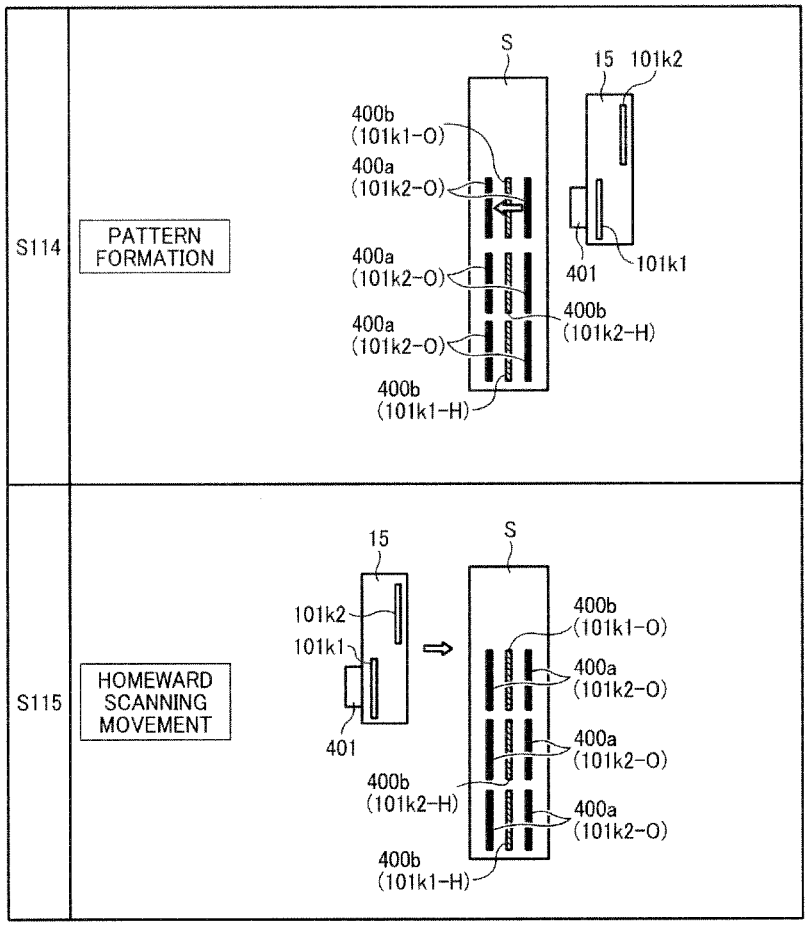
Figure 16E:
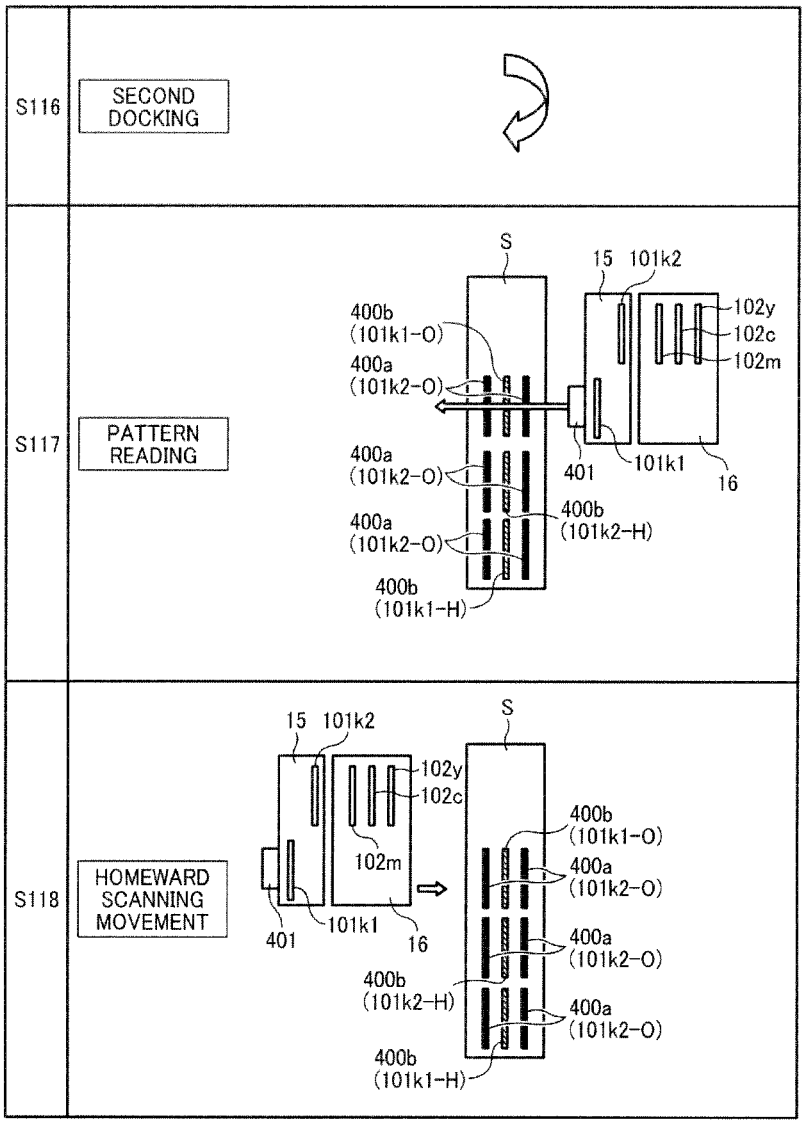

A description is now given of adjustment of the ejection timing based on scanning speed of the first and second carriages 15 and 16 between the reference pattern 400*a* and the measured pattern 400*b* of the adjustment pattern 400 with reference to FIG. 14. FIG. 14 is a schematic view illustrating an example of a basic configuration of the adjustment pattern 400.

Here, the minimum unit of the adjustment pattern 400 for detecting a shift in the landing positions is composed of the two reference patterns 400*a* and the measured pattern 400*b* arranged side by side in the main scanning direction without overlapping with each other. The measured pattern 400*b* is sandwiched by the two reference patterns 400*a*. In FIG. 14, one of the two reference patterns 400*a* formed in the left of the measured pattern 400*b* is hereinafter referred to as a reference pattern 400*a*1, and the other one of the reference patterns 400*a* formed in the right of the measured pattern 400*b* is hereinafter referred to as a reference pattern 400*a*2.

A distance between the reference patterns 400*a*1 and 400*a*2 and a distance between one of the reference patterns 400*a* and the measured pattern 400*b* are calculated by multiplying a difference between timings when the pattern detector 401 provided to the first carriage 15 detects each of the reference patterns 400*a*1 and 400*a*2 and the measured pattern 400*b* by a predetermined scanning speed of the first carriage 15. Next, a predetermined correction ratio of fluctuation in the scanning speed of the first carriage 15 calculated from the distance between the reference patterns 400*a*1 and 400*a*2 is added to the calculated distances to correct an amount of a positional shift of the measured pattern 400*b* from the reference patterns 400*a*. Then, the ejection timing is adjusted based on the corrected amount of the positional shift.

Specifically, when the first carriage 15 is moved in the main scanning direction so that the pattern detector 401 reads the adjustment pattern 400, a period of time from when the reference pattern 400*a*1 is detected to when the measured pattern 400*b* is detected is referred to as a time t2, and a period of time from when the reference pattern 400*a*1 is detected to when the reference pattern 400*a*2 is detected is referred to as a time t1. Referring the scanning speed of the first carriage 15 to as Vc, a distance L1 between the reference patterns 400*a*1 and 400*a*2 is calculated by a formula of L1=t1×Vc, and a distance L2 between the reference pattern 400*a*1 and the measured pattern 400*b* is calculated by a formula of L2=t2×Vc.

Here, a theoretical distance La2 from the reference pattern 400*a*1 to the measured pattern 400*b* is determined in advance. Therefore, the distance L2 is subtracted from the theoretical distance La2 to obtain the amount of positional shift of the measured pattern 400*b* from the reference pattern 400*a*1.

Meanwhile, a theoretical distance between the reference patterns 400*a*1 and 400*a*2 is referred to as a theoretical distance La1 when the first carriage 15 is moved at the predetermined scanning speed Vc. The distance L1 and the theoretical distance La1 are the same when the scanning speed Vc of the first carriage 15 is constant during reading of the adjustment pattern 400. However, when the scanning speed Vc of the first carriage 15 is changed during reading of the adjustment pattern 400, the distance L1 and the theoretical distance La1 are different from each other.

Therefore, the theoretical distance La1 is divided by the distance L1 to calculate the correction ratio of fluctuation in the scanning speed of the first carriage 15. The correction ratio thus calculated is multiplied by the amount of positional shift of the measured pattern 400*b* from the reference pattern 400*a*1 to obtain the accurate amount of positional shift when the first carriage 15 is moved at the predetermined scanning speed Vc.

A description is now given of formation and reading of the adjustment pattern 400 performed by the CPU 200 of the image forming apparatus 1 according to a first illustrative embodiment with reference to FIGS. 15A to 15D. FIGS. 15A to 15D are explanatory drawings illustrating steps in a process of formation and reading of the adjustment pattern 400 according to the first illustrative embodiment. It is to be noted that, in FIGS. 15A to 15D and successive drawings, the reference pattern 400*a* and the measured pattern 400*b* formed by the first recording head 101*k*2 during outward scanning movement of the first carriage 15 are denoted by "a reference pattern 400*a* (101*k*2-O)" and "a measured pattern 400*b* (101*k*2-O)", respectively. Similarly, the reference pattern 400*a* and the measured pattern 400*b* formed by the first recording head 101*k*1 during outward scanning movement of the first carriage 15 is denoted by "a reference pattern 400*a* (101*k*1-O)" and "a measured pattern 400*b* (101*k*1-O)", respectively. The measured pattern 400*b* formed by the first recording head 101*k*2 during homeward scanning movement of the first carriage 15 is denoted by "a measured pattern 400*b* (101*k*2-H)", and the measured pattern 400*b* formed by the first recording head 101*k*1 during homeward scanning movement of the first carriage 15 is denoted by "a measured pattern 400*b* (101*k*1-H)". Each row of the adjustment pattern 400 (hereinafter also referred to as an adjustment pattern row) is composed of a set of multiple reference patterns 400*a* and a measured pattern(s) 400*b* formed on the sheet S in the main scanning direction, and multiple rows of the adjustment patterns 400 are formed on the sheet S in a direction of feeding of the sheet S, that is, the sub-scanning direction. Specifically, a first row of the adjustment pattern 400 (hereinafter referred to as a first pattern row), a second row of the adjustment pattern 400 (hereinafter referred to as a second pattern row), and so on are formed on the sheet S from downstream to upstream in the sub-scanning direction, in that order.

At step S1, the first and second carriages 15 and 16 are separated from each other (first separation of the first and second carriages 15 and 16) at a docking/separation position where the first and second carriages 15 and 16 are docked with and separated from each other.

At step S2, the first carriage 15 is moved outward from the docking/separation position so that the first recording head 101*k*2 forms two reference patterns 400*a* of a first pattern row at a first pattern formation position on the sheet S. At step S3, the first carriage 15 is moved homeward to the docking/separation position, and the sheet S is fed in the sub-scanning direction such that the first pattern formation position on the sheet S is positioned corresponding to the first recording head 101*k*1.

At step S4, the first carriage 15 is moved outward so that the first recording head 101*k*1 forms a measured pattern 400*b* (101*k*1-O) between the two reference patterns 400*a* of the first pattern row formed at step S2. Accordingly, formation of the first pattern row is completed. In addition, during the same outward scanning movement of the first carriage 15, the first recording head 101*k*2 forms two reference patterns 400*a* of a second pattern row at a second pattern formation position on the sheet S.

At step S5, the first carriage 15 is moved homeward so that the first recording head 101*k*2 forms a measured pattern 400*b* (101*k*2-H) between the two reference patterns 400*a* of the second pattern row formed at step S4. Accordingly, formation of the second pattern row is completed. Then, the first carriage 15 is returned to the docking/separation position.

At step S6, the first and second carriages 15 and 16 are docked with each other (first docking of the first and second carriages 15 and 16) at the docking/separation position.

At step S7, the first and second carriages 15 and 16 docked with each other are together moved outward from the docking/separation position so that the pattern detector 401 provided to the first carriage 15 reads the measured pattern 400*b* (101*k*1-O) and the reference patterns 400*a* on either side of the measured pattern 400*b* (101*k*1-O) of the first pattern row. After the sheet S is fed in the sub-scanning direction such that the second pattern row is positioned corresponding to the pattern detector 401, at step S8 the first and second carriages 15 and 16 are moved homeward.

At step S9, the first carriage 15 with which the second carriage 16 is docked is moved outward so that the pattern detector 401 reads the measured pattern 400*b* (101*k*2-H) and the reference patterns 400*a* on either side of the measured pattern 400*b* of the second pattern row.

At step S10, the first and second carriages 15 and 16 are moved homeward to the docking/separation position.

At step S11, the first and second carriages 15 and 16 are separated from each other (second separation of the first and second carriages 15 and 16).

At step S12, the first carriage 15 is moved outward so that the first recording head 101*k*2 forms two reference patterns 400*a* of a third pattern row at a third pattern formation position on the sheet S, and then the sheet S is fed in the sub-scanning direction such that the third pattern formation position on the sheet S is positioned corresponding to the first recording head 101*k*1. At step S13, the first carriage 15 is moved homeward to the docking/separation position so that the first recording head 101*k*1 forms a measured pattern 400*b* (101*k*1-H) between the two reference patterns 400*a* of the third pattern row formed at step S12 to complete formation of the third pattern row.

At step S14, the first and second carriages 15 and 16 are docked with each other (second docking of the first and second carriages 15 and 16).

At step S15, the first and second carriages 15 and 16 docked with each other are together moved outward so that the pattern detector 401 reads the measured pattern 400*b* (101*k*1-H) and the two reference patterns 400*a* on either side of the measured pattern 400*b* of the third pattern row, and then at step S16 the first and second carriages 15 and 16 are moved homeward to the docking/separation position.

As described above, the two reference patterns 400*a* are formed by the first recording head 101*k*2 during outward scanning movement of the first carriage 15, and then the measured pattern 400*b* is formed between the reference patterns 400*a* by the first recording head 101*k*2 during homeward scanning movement of the first carriage 15 and by the first recording head 101*k*1 during outward and homeward scanning movement of the first carriage 15.

Specifically, according to the first illustrative embodiment, the first recording head 101*k*2 positioned upstream from the first recording head 101*k*1 in the direction of sheet feed forms the reference patterns 400*a* during outward scanning movement of the first carriage 15. In addition, the measured pattern 400*b* is formed between the reference patterns 400*a* by the first recording head 101*k*2 during homeward scanning movement of the first carriage 15 and the first recording head 101*k*1 during outward and homeward scanning movement of the first carriage 15 so as to correct the landing positions of the ink droplets.

At this time, the pattern detector 401 successively reads at least two rows of the adjustment patterns 400 formed on the sheet S in the sub-scanning direction without docking and separation of the first and second carriages 15 and 16.

In the first illustrative embodiment, at least the two reference patterns 400*a* and the measured pattern 400*b* sandwiched by the two reference patterns 400*a* are formed in a row in the main scanning direction to form an adjustment pattern row on the sheet S. In addition, multiple adjustment pattern rows are formed on the sheet S in the sub-scanning direction. A distance between at least one of the two reference patterns 400*a* and the measured pattern 400*b* or a scanning time of the first carriage 15 is calculated based on a result detected by the pattern detector 401 to correct a shift in the landing positions of the ink droplets. At this time, the pattern detector 401 successively reads at least two rows of the adjustment patterns 400 formed on the sheet S in the sub-scanning direction without docking and separation of the first and second carriages 15 and 16. Accordingly, the number of times the first and second carriages 15 and 16 are docked with or separated from each other is reduced during automatic adjustment of the landing positions, thereby shortening downtime.

In addition, the first recording head 101*k*2 positioned upstream from the first recording head 101*k*1 in the direction of sheet feed, that is, the sub-scanning direction, is used for forming the reference patterns 400*a*. As a result, the number of times the first and second carriages 15 and 16 are docked with and separated from each other can be reduced compared to a case, described in detail later, in which the reference patterns 400*a* are formed by the first recording head 101*k*1.

The first recording head 101*k*1 positioned downstream from the first recording head 101*k*2 in the direction of sheet feed forms the measured pattern 400*b* while the first recording head 101*k*2 positioned upstream from the first recording head 101*k*1 in the direction of sheet feed is forming the reference patterns 400*a* of the next pattern row during single outward scanning movement of the first carriage 15. Accordingly, the number of times the first and second carriages 15 and 16 are docked with and separated from each other can be reduced.

Further, the first and second carriages 15 and 16 docked with each other are together moved in a single direction from the docking/separation position when the adjustment pattern 400 is read by the pattern detector 401. Accordingly, the adjustment pattern 400 can be read with substantially consistent accuracy.

The pattern detector 401 is disposed on the first carriage 15 closer to the first recording head 101*k*1 positioned downstream from the first recording head 101*k*2 in the direction of sheet feed than to the first recording head 101*k*2. Accordingly, the number of times the first and second carriages 15 and 16 are docked with and separated from each other can be reduced.

A description is now given of formation and reading of the adjustment pattern 400 according to a second illustrative embodiment with reference to FIGS. 16A to 16E. FIGS. 16A to 16E are explanatory drawings illustrating steps in a process of formation and reading of the adjustment pattern 400 according to the second illustrative embodiment.

At step S101, the first and second carriages 15 and 16 are separated from each other (first separation of the first and second carriages 15 and 16) at the docking/separation position.

At step S102, the first carriage 15 is moved outward from the docking/separation position so that the first recording head 101*k*2 forms two reference patterns 400*a* of a first pattern row at a first pattern formation position on the sheet S. Then, the sheet S is fed in the sub-scanning direction such that the first pattern formation position is positioned corresponding to the first recording heads 101*k*1. At step S103, the first carriage 15 is moved homeward to the docking/separation position so that the first recording head 101*k*1 forms a measured pattern 400*b* (101*k*1-H) between the two reference patterns 400*a* of the first pattern row formed at step S102 to complete formation of the first pattern row while the first recording head 101*k*2 is forming a measured pattern 400*b* (101*k*2-H) of a second pattern row at a second pattern formation position on the sheet S.

At step S104, the first carriage 15 is moved outward so that the first recording head 101*k*2 forms two reference patterns 400*a* that sandwich the measured pattern 400*b* (101*k*2-H) of the second pattern row formed at step S103 to complete formation of the second pattern row. At step S105, the first carriage 15 is moved homeward to the docking/separation position.

At step S106, the first and second carriages 15 and 16 are docked with each other (first docking of the first and second carriages 15 and 16).

At step S107, the first and second carriages 15 and 16 docked with each other are together moved outward so that the pattern detector 401 reads the measured pattern 400*b* (101*k*1-H) and the reference patterns 400*a* on either side of the measured pattern 400*b* (101*k*1-H) of the first pattern row. After the sheet S is fed in the sub-scanning direction such that the second pattern formation position on the sheet S is positioned corresponding to the pattern detector 401, at step S108 the first and second carriages 15 and 16 are moved homeward to the docking/separation position.

At step S109, the first carriage 15 with which the second carriage 16 is docked is moved outward so that the pattern detector 401 reads the measured pattern 400*b* (101*k*2-H) and the reference patterns 400*a* on either side of the measured pattern 400*b* (101*k*2-H) of the second pattern row. At step S110, the first and second carriages 15 and 16 are moved homeward to the docking/separation position.

At step S111, the first and second carriages 15 and 16 are separated from each other (second separation of the first and second carriages 15 and 16).

At step S112, the first carriage 15 is moved outward so that the first recording heads 101*k*2 forms two reference patterns 400*a* of a third pattern row at a third pattern formation position on the sheet S, and then the sheet S is fed such that the third pattern formation position is positioned corresponding to the first recording head 101*k*1. At step S113, the first carriage 15 is moved homeward.

At step S114, the first carriage 15 is moved outward so that the first recording head 101*k*1 forms a measured pattern 400*b* (101*k*1-O) between the reference patterns 400*a* of the third pattern row formed at step S112 to complete formation of the third pattern row. At step S115, the first carriage 15 is moved homeward to the docking/separation position.

At step S116, the first and second carriages 15 and 16 are docked with each other (second docking of the first and second carriages 15 and 16).

At step S117, the first and second carriages 15 and 16 docked with each other are together moved outward so that the pattern detector 401 reads the measured pattern 400*b* (101*k*1-O) and the two reference patterns 400*a* on either side of the measured pattern 400*b* (101*k*1-O) of the third pattern row, and then at S118 the first and second carriages 15 and 16 are moved homeward to the docking/separation position.

Similar to the first illustrative embodiment, the pattern detector 401 successively reads at least two rows of the adjustment patterns 400 formed on the sheet S in the sub-scanning direction without docking and separation of the first and second carriages 15 and 16. However, in the second illustrative embodiment, the measured pattern 400*b* (101*k*1-O) is not formed during outward scanning movement of the first carriage 15 while the reference patterns 400*a* are formed by the first recording head 101*k*2. As a result, the number of scanning movements of the first carriage 15 is increased by one reciprocating movement compared to the first illustrative embodiment.

Figure 17A:
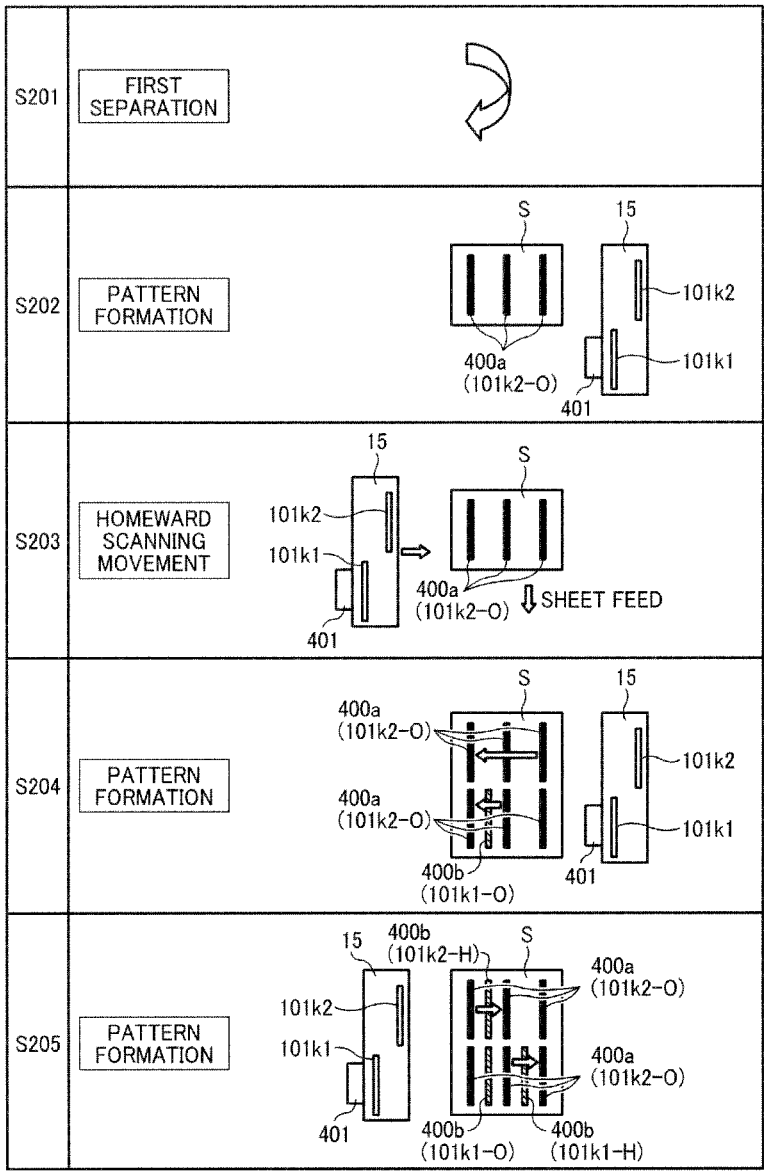
FIGS. 17A to 17C are explanatory drawings illustrating steps in a process of formation and reading of the adjustment pattern according to a third illustrative embodiment.
Figure 17B:
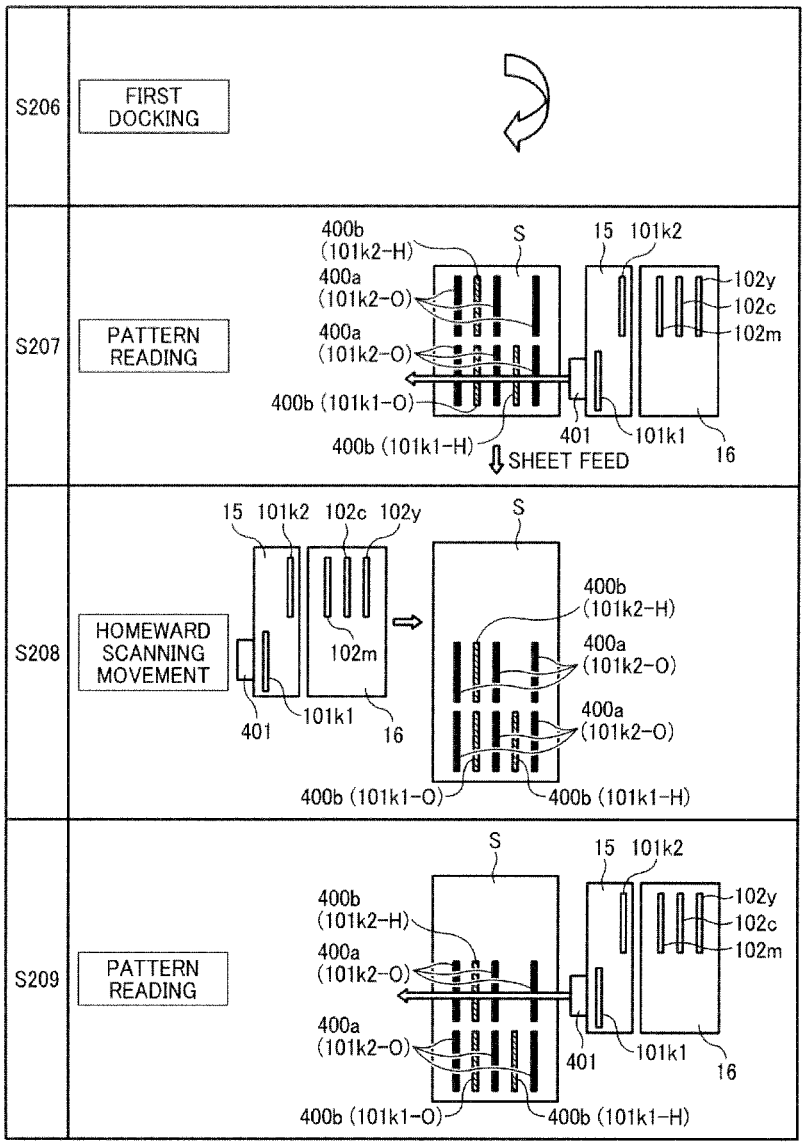
Figure 17C:
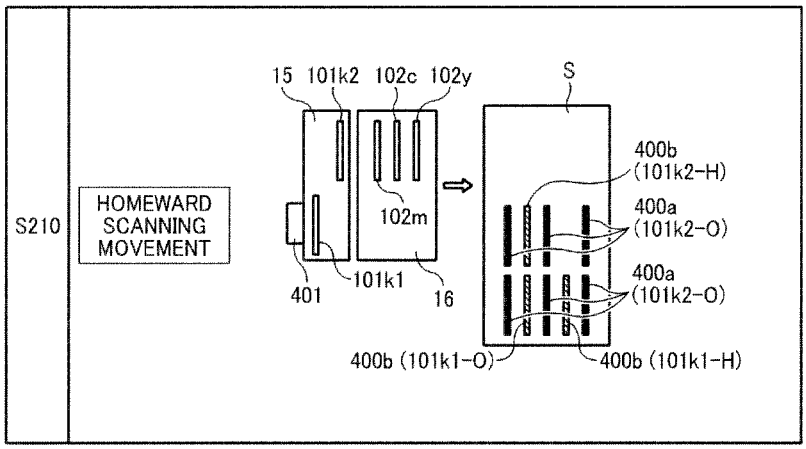
Figure 18A:
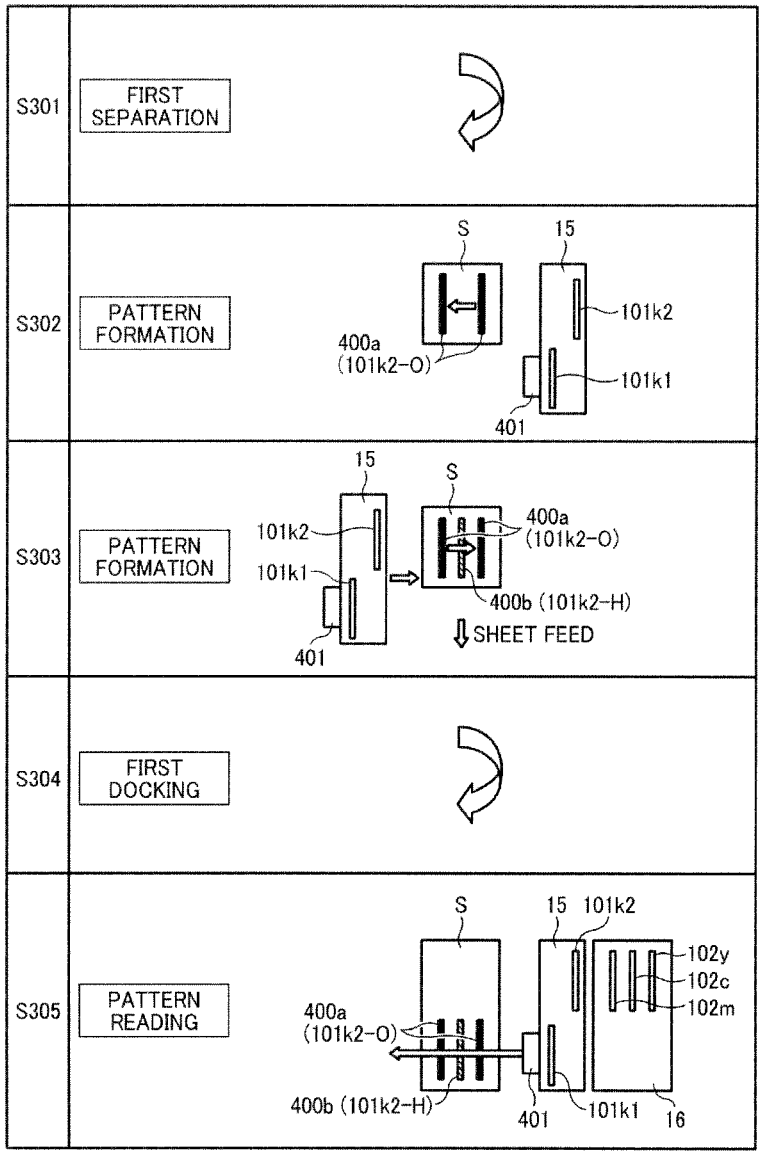
FIGS. 18A to 18F are explanatory drawings illustrating steps in a process of formation and reading of the adjustment pattern according to a first comparative example.
Figure 18B:
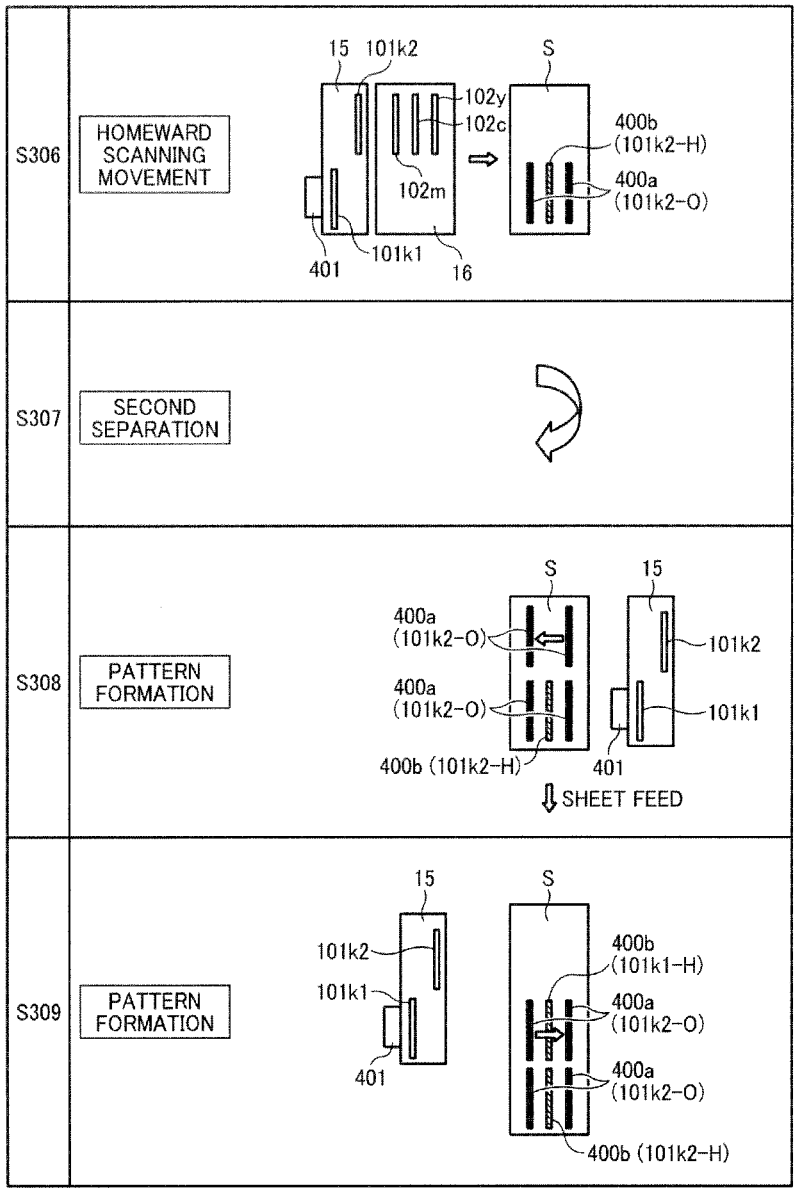
Figure 18C:
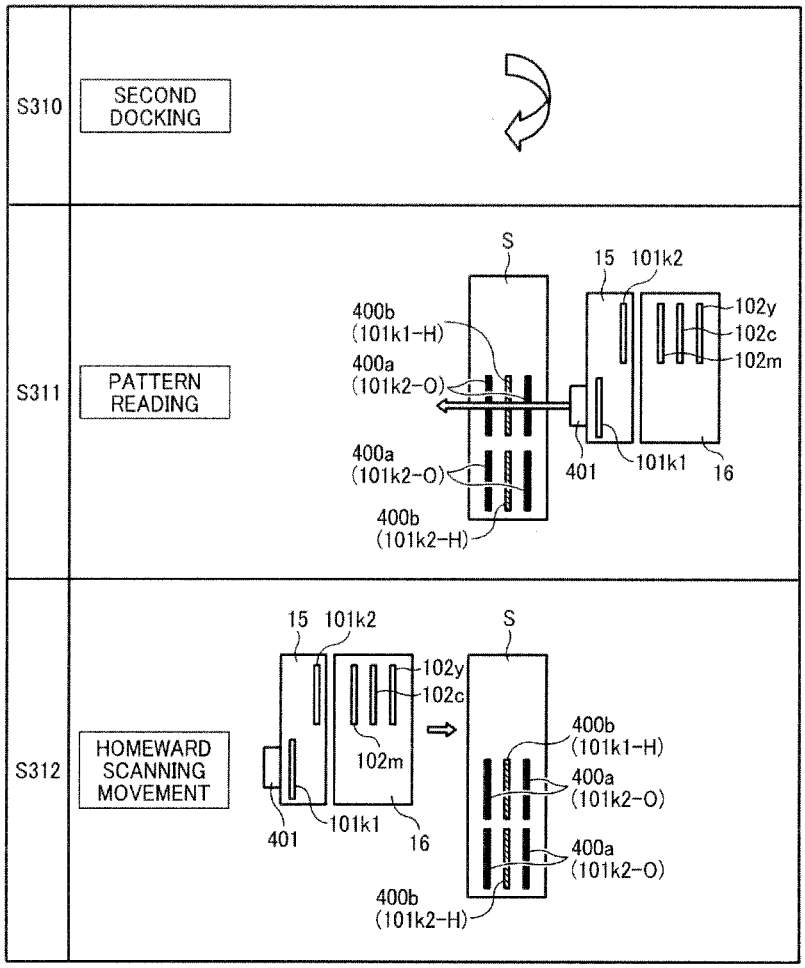
Figure 18D:
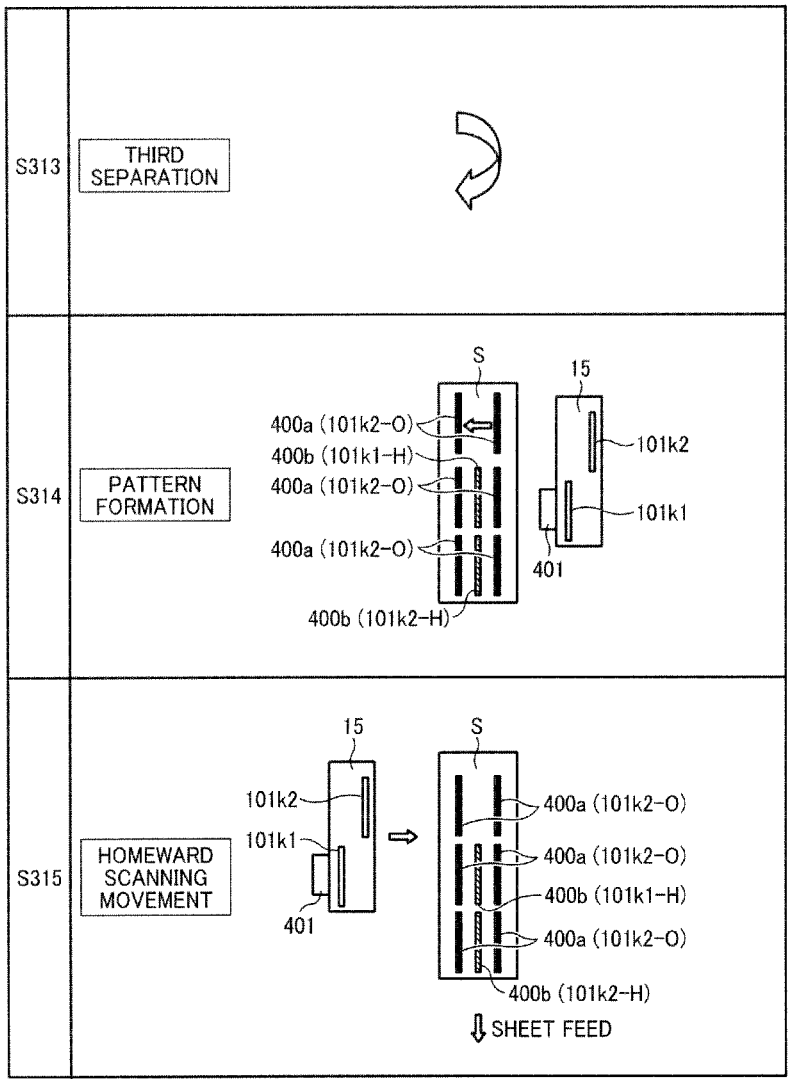
Figure 18E:
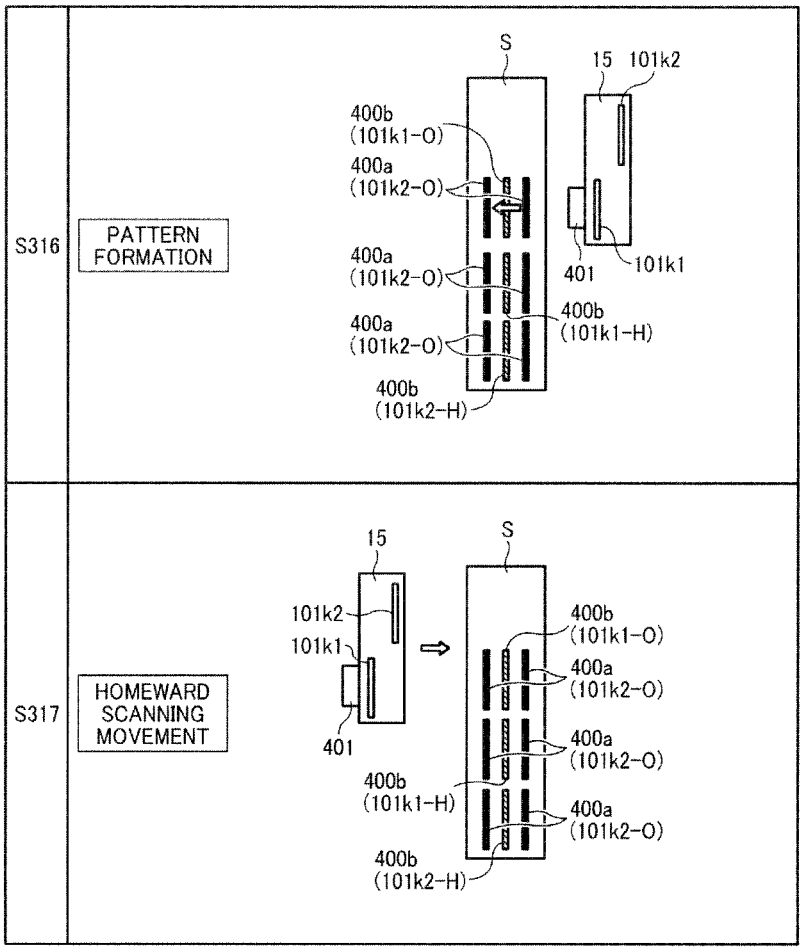
Figure 18F:
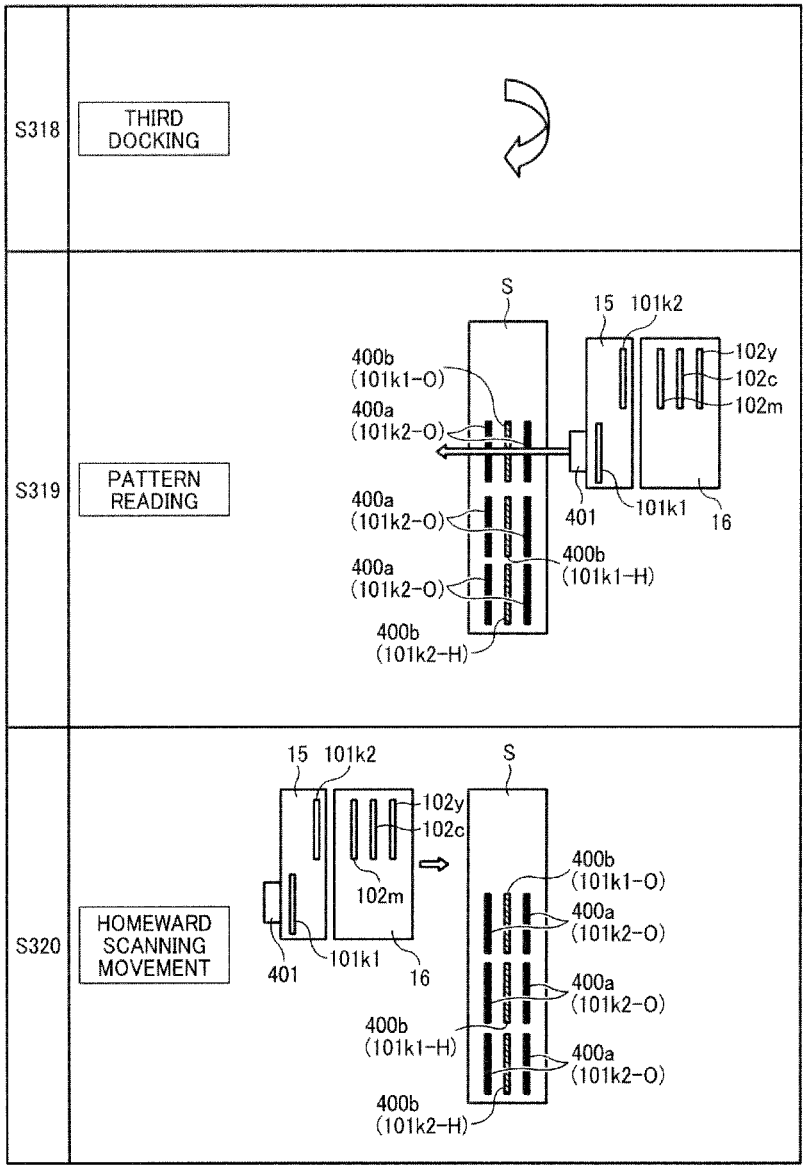
Figure 19A:
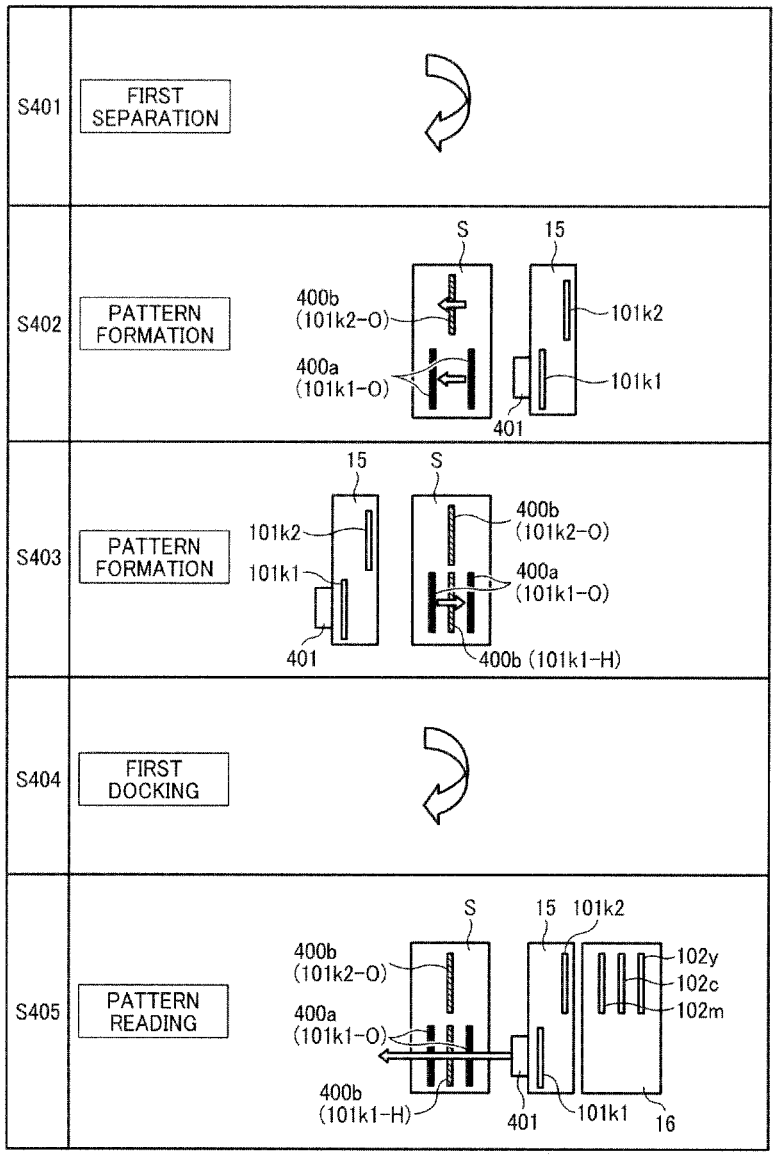
FIGS. 19A to 19E are explanatory drawings illustrating steps in a process of formation and reading of the adjustment pattern according to a second comparative example.
Figure 19B:
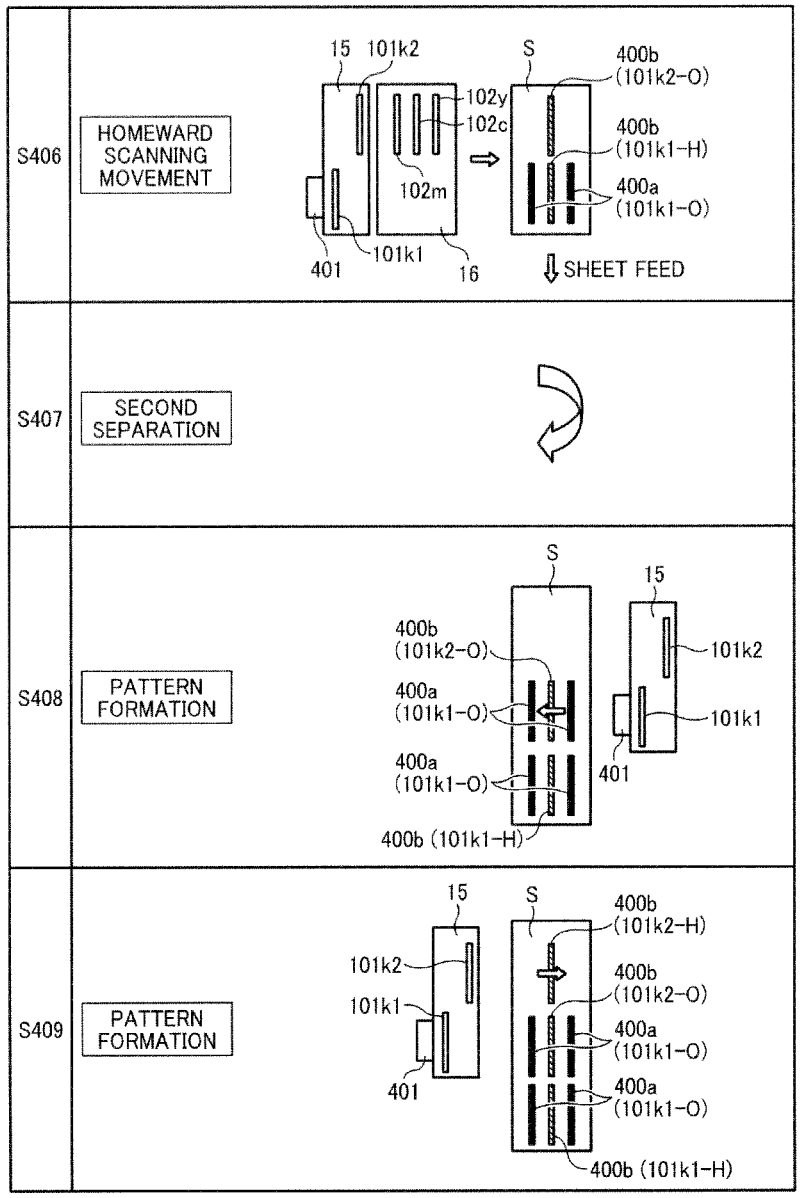
Figure 19C:
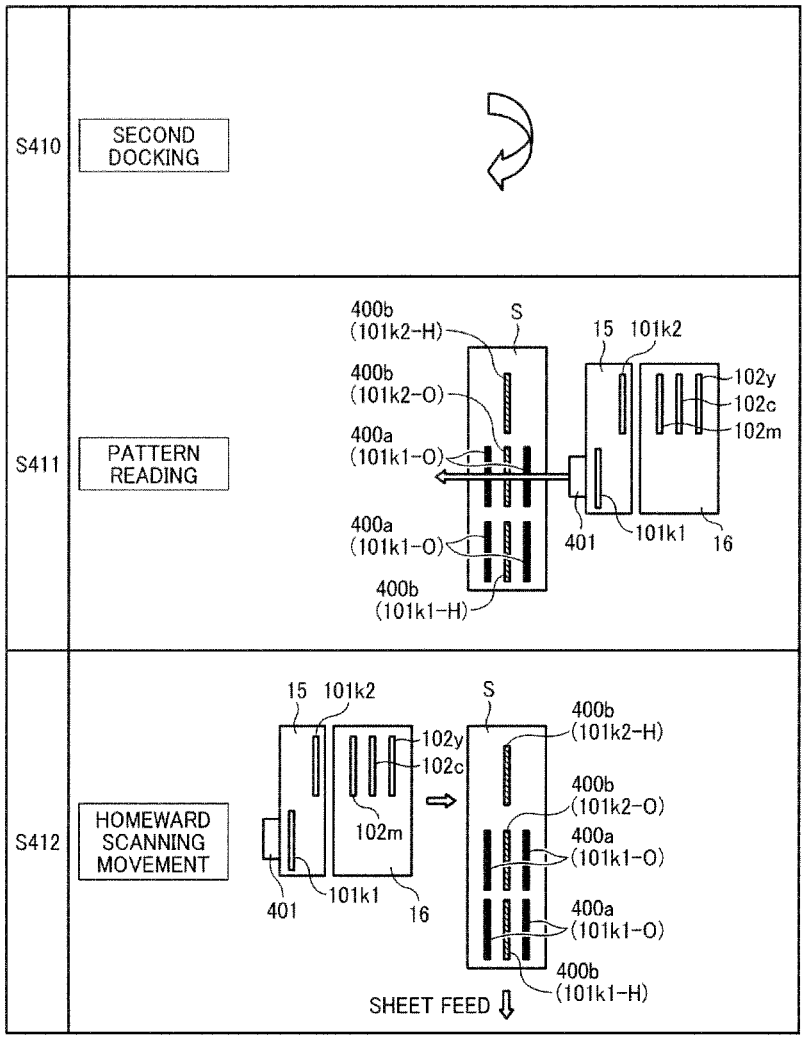
Figure 19D:
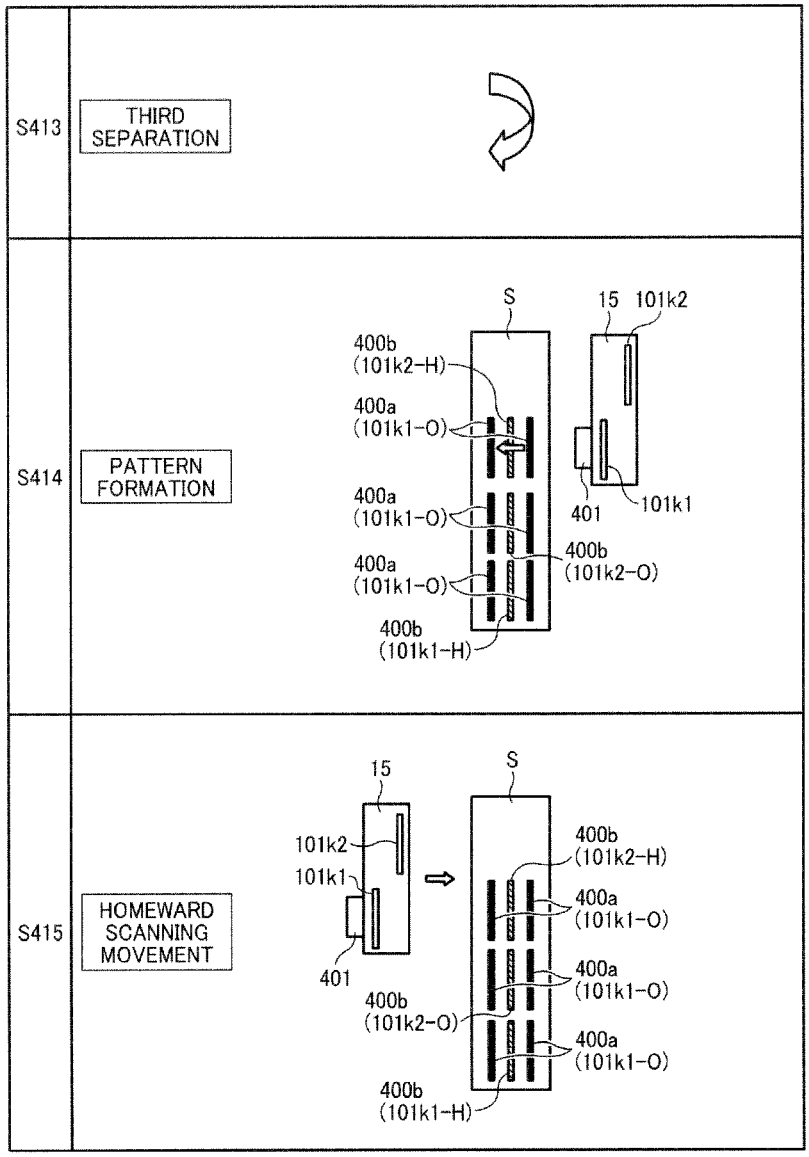
Figure 19E:
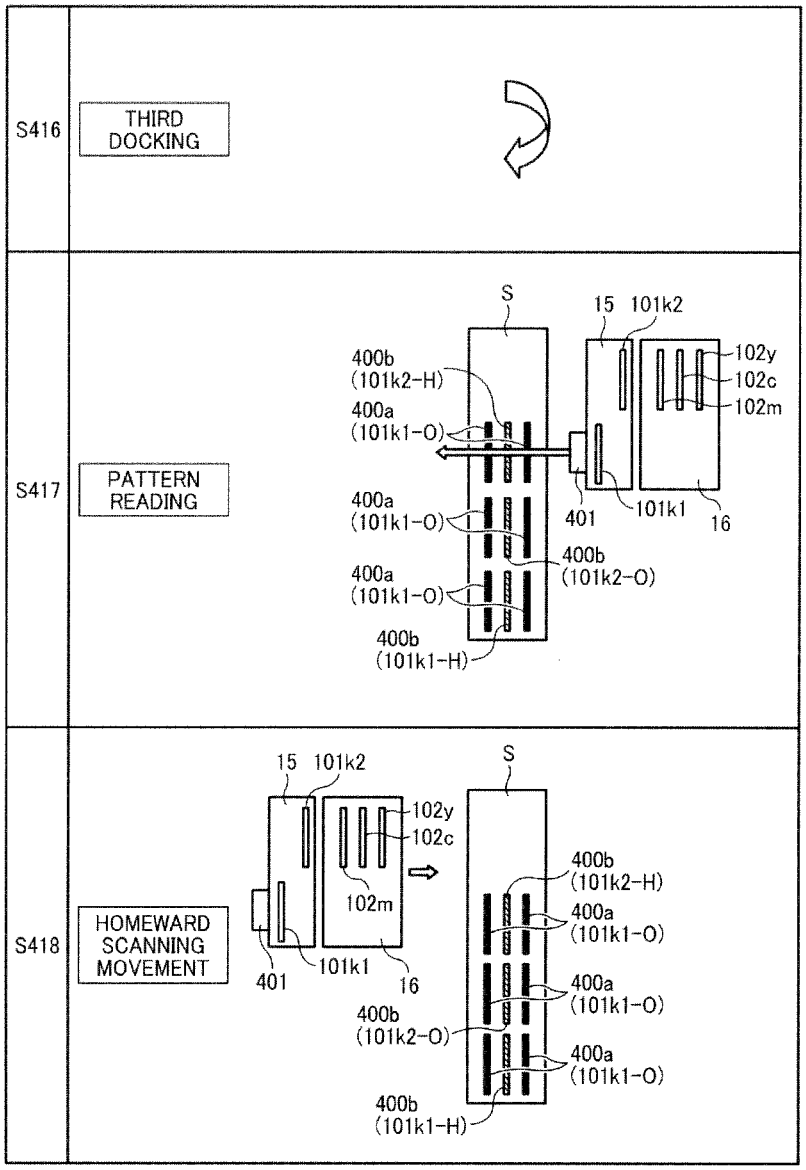
Figure 20A:
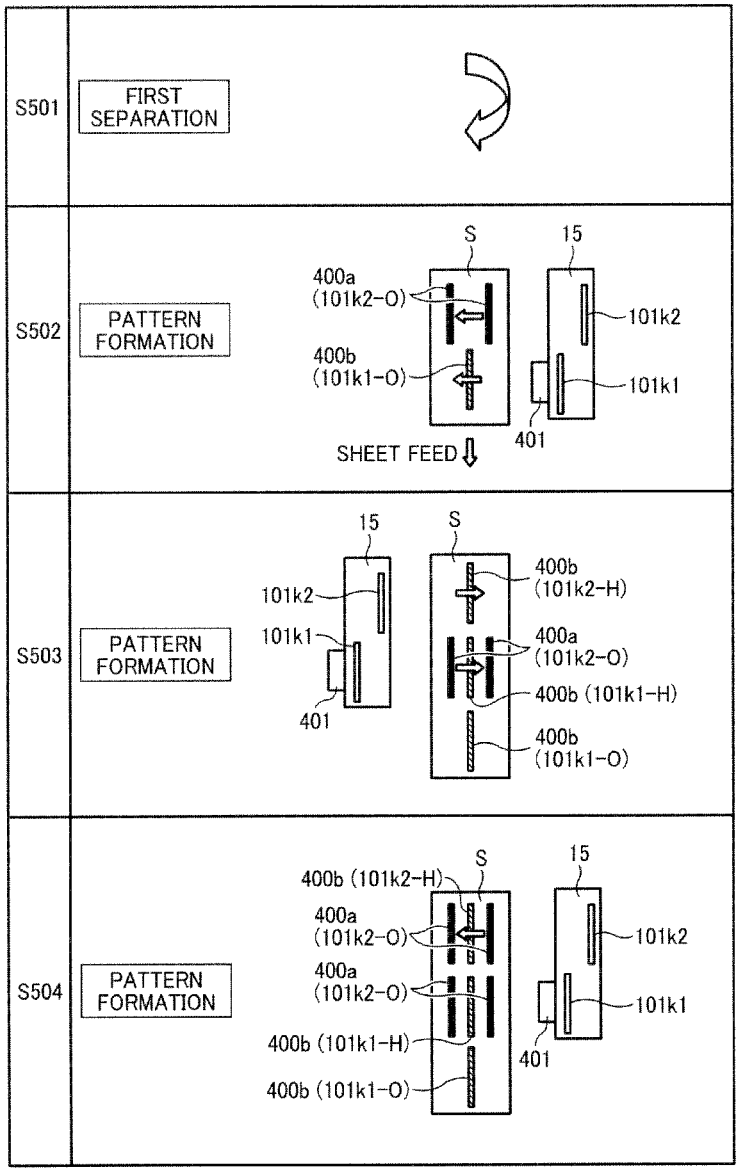
FIGS. 20A to 20D are explanatory drawings illustrating steps in a process of formation and reading of the adjustment pattern according to a third comparative example.
Figure 20B:
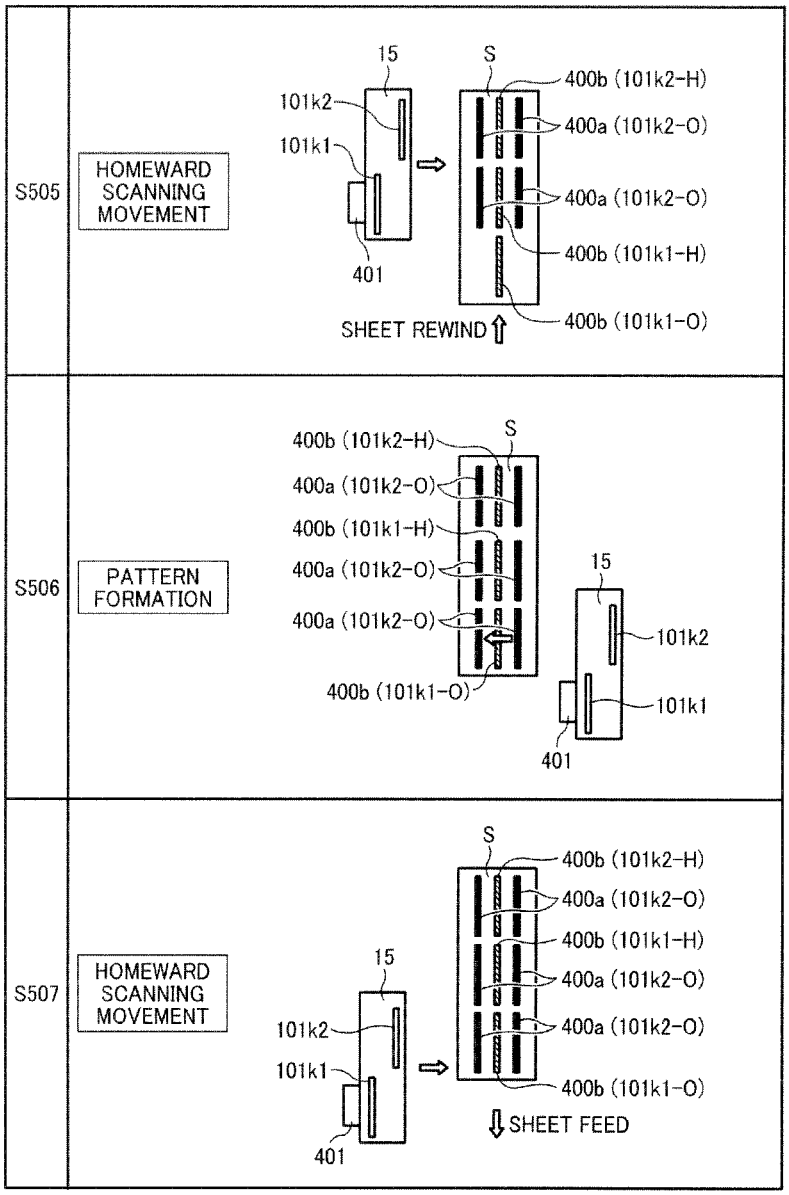
Figure 20C:
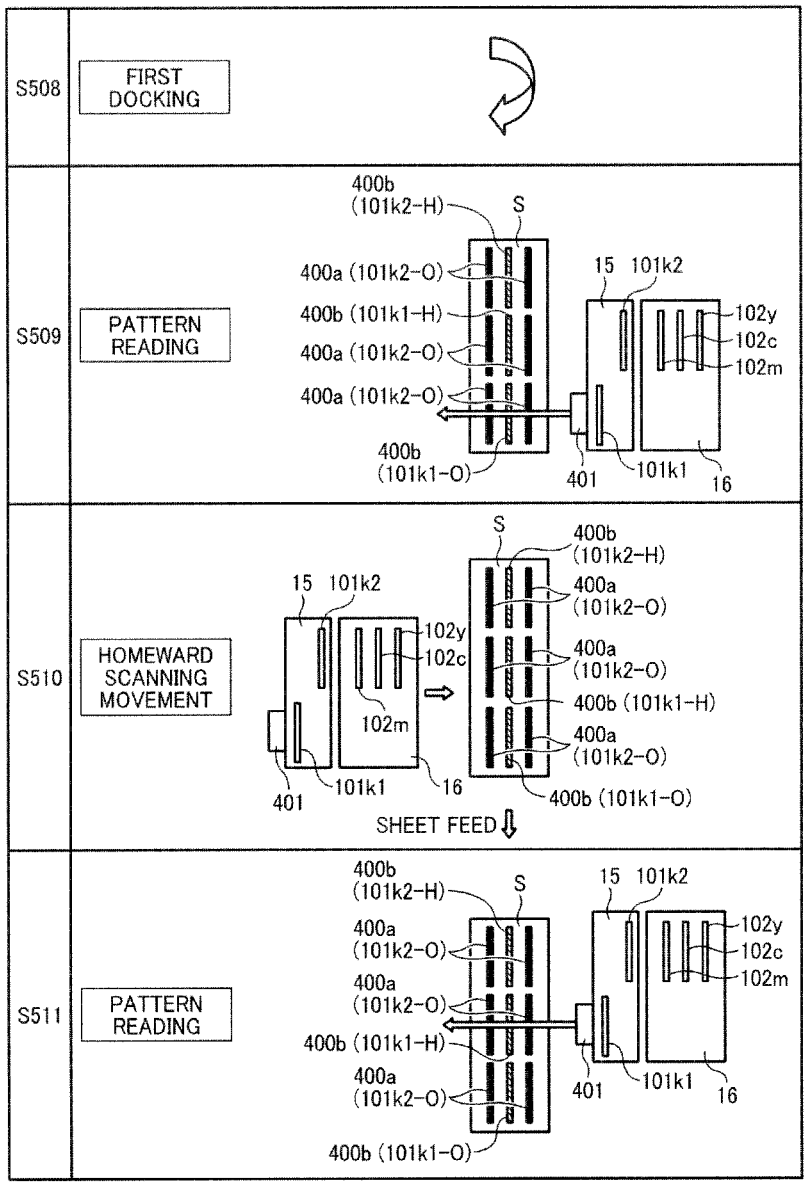
Figure 20D:
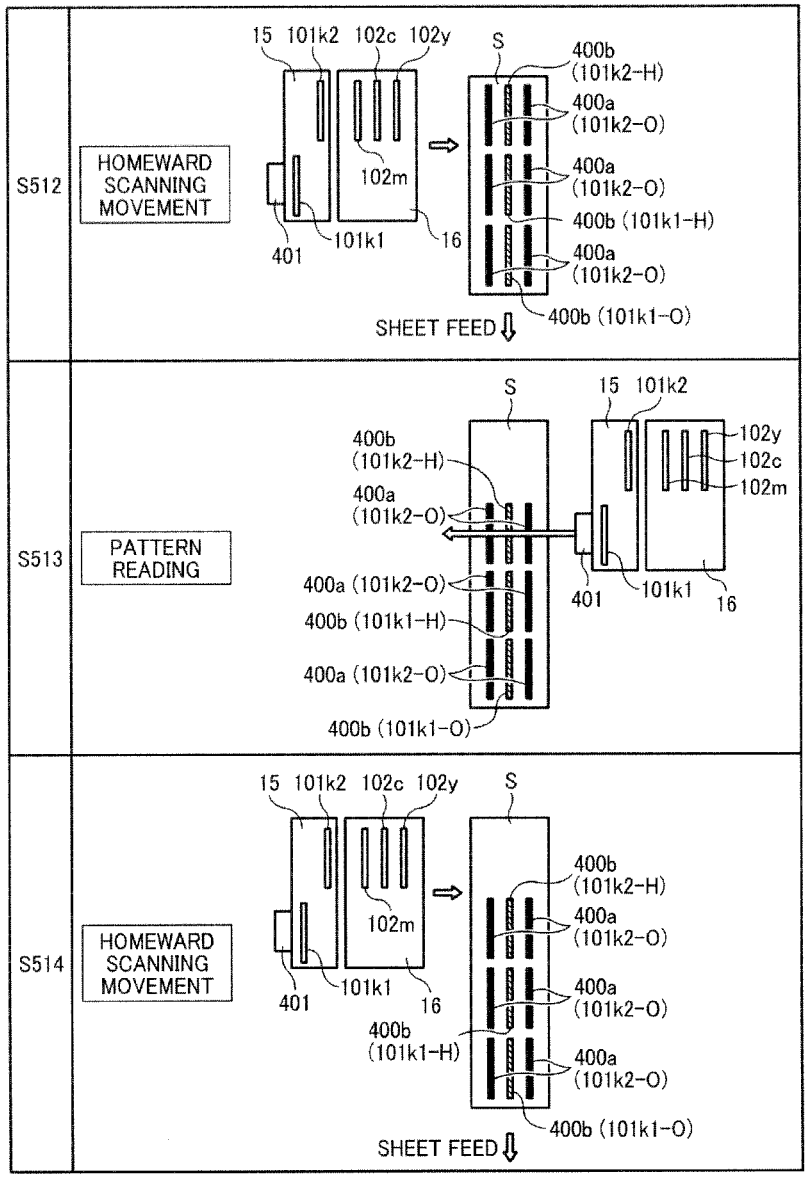

A description is now given of formation and reading of the adjustment pattern 400 according to a third illustrative embodiment with reference to FIGS. 17A to 17C. FIGS. 17A to 17C are explanatory drawings illustrating steps in a process of formation and reading of the adjustment pattern 400 according to the third illustrative embodiment.

At step S201, the first and second carriages 15 and 16 are separated from each other (first separation of the first and second carriages 15 and 16) at the docking/separation position.

At step S202, the first carriage 15 is moved outward so that the first recording head 101*k*2 forms three reference patterns 400*a* of a first pattern row at a first pattern formation position on the sheet S. Then, at S203 the first carriage 15 is moved homeward and the sheet S is fed in the sub-scanning direction such that the first pattern formation position on the sheet S is positioned corresponding to the first recording head 101*k*1.

At step S204, the first carriage 15 is moved outward so that the first recording head 101*k*1 forms a measured pattern 400*b* (101*k*1-O) between the left and middle reference patterns 400*a* of the three reference patterns 400*a* of the first pattern row formed at step S202 while the first recording head 101*k*2 forms three reference patterns 400*a* of a second pattern row at a second pattern formation position on the sheet S.

At step S205, the first carriage 15 is moved homeward so that the first recording head 101*k*1 forms a measured pattern 400*b* (101*k*1-H) between the right and middle reference patterns 400*a* of the three reference patterns 400*a* of the first pattern row to complete formation of the first pattern row while the first recording head 101*k*2 forms a measured pattern 400*b* (101*k*2-H) between the left and middle reference patterns 400*a* of the three reference patterns 400*a* of the second pattern row formed at step S204 on the sheet S. Then, the first carriage 15 is returned to the docking/separation position.

At step S206, the first and second carriages 15 and 16 are docked with each other (first docking of the first and second carriages 15 and 16).

At step S207, the first and second carriages 15 and 16 docked with each other are together moved outward so that the pattern detector 401 reads the measured patterns 400*b* (101*k*1-H and 101*k*1-O) and the three reference patterns 400*a* respectively on either side of the measured patterns 400*b* (101*k*1-H and 101*k*1-O) of the first pattern row. After the sheet S is fed in the sub-scanning direction such that the second pattern formation position on the sheet S is positioned corresponding to the pattern detector 401, at step S208 the first and second carriages 15 and 16 are moved homeward to the docking/separation position.

At step S209, the first carriage 15 with which the second carriage 16 is docked is moved outward so that the pattern detector 401 reads the measured pattern 400*b* (101*k*2-H) and the two reference patterns 400*a* on either side of the measured pattern 400*b* (101*k*2-H), that is, the left and middle reference patterns 400*a* of the three reference patterns 400*a* of the second pattern row. At step S210, the first and second carriages 15 and 16 are moved homeward to the docking/separation position.

Similar to the first and second illustrative embodiments, the pattern detector 401 successively reads at least two rows of the adjustment patterns 400 formed on the sheet S in the sub-scanning direction without docking and separation of the first and second carriages 15 and 16. However, in the third illustrative embodiment, the three reference patterns 400*a* are formed all at once during the same outward scanning movement of the first carriage 15. Accordingly, the measured patterns 400*b* (101*k*1-O), (101*k*1-H), and (101*k*2-H), each necessary for correction of the landing positions, are formed by a single reciprocating movement of the first carriage 15, thereby reducing the number of times the first and second carriages 15 and 16 are docked with and separated from each other and the number of scanning movements of the first carriage 15 compared to the first illustrative embodiment.

To better appreciate the advantages and unpredicted effect of the above-described embodiments of the present invention, a description is now given of formation and reading of the adjustment pattern 400 according to comparative examples. In the comparative examples described below, the pattern detector 401 does not successively reads multiple rows of the adjustment patterns 400 formed on the sheet S in the sub-scanning direction without docking and separation of the first and second carriages 15 and 16.

FIGS. 18A to 18F are explanatory drawings illustrating steps in a process of formation and reading of the adjustment pattern 400 according to a first comparative example.

Similar to the foregoing illustrative embodiments, the first recording head 101*k*2 forms the reference patterns 400*a* in the first comparative example.

At step S301, the first and second carriages 15 and 16 are separated from each other (first separation of the first and second carriages 15 and 16) at the docking/separation position.

At step S302, the first carriage 15 is moved outward so that the first recording head 101*k*2 forms two reference patterns 400*a* of a first pattern row at a first pattern formation position on the sheet S. At step S303, the first carriage 15 is moved homeward so that the first recording head 101*k*2 forms a measured pattern 400*b* (101*k*2-H) between the two reference patterns 400*a* of the first pattern row formed at step S302 to complete formation of the first pattern row. Then, the sheet S is fed in the sub-scanning direction such that the first pattern formation position on the sheet S is positioned corresponding to the pattern detector 401, and the first carriage 15 is returned to the docking/separation position.

At step S304, the first and second carriages 15 and 16 are docked with each other (first docking of the first and second carriages 15 and 16).

At step S305, the first and second carriages 15 and 16 docked with each other are together moved outward so that the pattern detector 401 reads the measured pattern 400*b* (101*k*2-H) and the reference patterns 400*a* on either side of the measured pattern 400*b* (101*k*2-H) of the first pattern row. At step S306, the first and second carriages 15 and 16 are moved homeward to the docking/separation position.

At step S307, the first and second carriages 15 and 16 are separated from each other (second separation of the first and second carriages 15 and 16).

At step S308, the first carriage 15 is moved outward so that the first recording head 101*k*2 forms two reference patterns 400*a* of a second pattern row at a second pattern formation position on the sheet S, and then the sheet S is fed in the sub-scanning position such that the second pattern formation position on the sheet S is positioned corresponding to the first recording head 101*k*1. At step S309, the first carriage 15 is moved homeward so that the first recording head 101*k*1 forms a measured pattern 400*b* (101*k*1-H) between the two reference patterns 400*a* of the second pattern row formed at step S308 to complete formation of the second pattern row. Then, the first carriage 15 is returned to the docking/separation position.

At step S310, the first and second carriages 15 and 16 are docked with each other (second docking of the first and second carriages 15 and 16).

At step S311, the first and second carriages 15 and 16 docked with each other are together moved outward so that the pattern detector 401 reads the measured pattern 400*b* (101*k*1-H) and the two reference patterns 400*a* on either side of the measured pattern 400*b* (101*k*1-H) of the second pattern row, and then at S312, the first and second carriages 15 and 16 are moved homeward to the docking/separation position.

At step S313, the first and second carriages 15 and 16 are separated from each other (third separation of the first and second carriages 15 and 16).

At step S314, the first carriage 15 is moved outward so that the first recording head 101*k*2 forms two reference patterns 400*a* of a third pattern row at a third pattern formation position on the sheet S. At step S315, the first carriage 15 is moved homeward. At this time, the sheet S is fed in the sub-scanning direction such that the third pattern formation position on the sheet S is positioned corresponding to the first recording head 101*k*1.

At step S316, the first carriage 15 is moved outward so that the first recording head 101*k*1 forms a measured pattern 400*b* (101*k*1-O) between the two reference patterns 400*a* of the third pattern row formed at step S314 to complete formation of the third pattern row. At step S317, the first carriage is moved homeward to the docking/separation position.

At step S318, the first and second carriages 15 and 16 are docked with each other (third docking of the first and second carriages 15 and 16).

At step S319, the first and second carriages 15 and 16 docked with each other are together moved outward so that the pattern detector 401 reads the measured pattern 400*b* (101*k*1-O) and the two reference patterns 400*a* on either side of the measured pattern 400*b* (101*k*1-O) of the third pattern row, and then at S320, the first and second carriages 15 and 16 are moved homeward to the docking/separation position.

As described above, in the first comparative example, the pattern detector 401 does not successively read multiple rows of the adjustment patterns 400 formed on the sheet S in the sub-scanning direction without docking and separation of the first and second carriages 15 and 16. Consequently, docking or separation of the first and second carriages 15 and 16 needs to be performed each time the adjustment pattern row is formed or read. As a result, the number of times the first and second carriages 15 and 16 are docked with and separated from each other is increased, thereby extending downtime for correcting the landing positions.

A description is now given of formation and reading of the adjustment pattern 400 according to a second comparative example with reference to FIGS. 19A to 19E. FIGS. 19A to 19E are explanatory drawings illustrating steps in a process of formation and reading of the adjustment pattern 400 according to the second comparative example. In the second comparative example, in place of the first recording head 101*k*2, the first recording head 101*k*1 positioned downstream from the first recording head 101*k*2 in the direction of sheet feed forms the reference patterns 400*a*.

At step S401, the first and second carriages 15 and 16 are separated from each other (first separation of the first and second carriages 15 and 16) at the docking/separation position.

At step S402, the first carriage 15 is moved outward so that the first recording head 101*k*1 forms two reference patterns 400*a* of a first pattern row at a first pattern formation position on the sheet S while the first recording head 101*k*2 forms a measured pattern 400*b* (101*k*2-O) of a second pattern row at a second pattern formation position on the sheet S.

At step S403, the first carriage 15 is moved homeward so that the first recording head 101*k*1 forms a measured pattern 400*b* (101*k*1-H) between the two reference patterns 400*a* of the first pattern row formed at step S402 to complete formation of the first pattern row. Then, the first carriage 15 is returned to the docking/separation position.

At S404, the first and second carriages 15 and 16 are docked with each other (first docking of the first and second carriages 15 and 16).

At step S405, the first and second carriages 15 and 16 docked with each other are together moved outward so that the pattern detector 401 reads the measured pattern 400*b* (101*k*1-H) and the reference patterns 400*a* on either side of the measured pattern 400*b* (101*k*1-H) of the first pattern row. At step S406, the first and second carriages 15 and 16 are moved homeward to the docking/separation position. At this time, the sheet S is fed in the sub-scanning position such that the second pattern formation position on the sheet S is positioned corresponding to the first recording head 101*k*1.

At step S407, the first and second carriages 15 and 16 are separated from each other (second separation of the first and second carriages 15 and 16).

At step S408, the first carriage 15 is moved outward so that the first recording head 101*k*1 forms two reference patterns 400*a* of the second pattern row that sandwich the measured pattern 400*b* (101*k*2-O) formed at step S402 to complete formation of the second pattern row. At step S409, the first carriage 15 is moved homeward so that the first recording head 101*k*2 form a measured pattern 400*b* (101*k*2-H) of a third pattern row at a third pattern formation position on the sheet S. Then, the first carriage 15 is returned to the docking/separation position.

At step S410, the first and second carriages 15 and 16 are docked with each other (second docking of the first and second carriages 15 and 16).

At step S411, the first and second carriages 15 and 16 docked with each other are together moved outward so that the pattern detector 401 reads the measured pattern 400*b* (101*k*2-O) and the two reference patterns 400*a* on either side of the measured pattern 400*b* (101*k*2-O) of the second pattern row, and then at S412, the first and second carriages 15 and 16 are moved homeward to the docking/separation position. At this time, the sheet S is fed in the sub-scanning direction such that the third pattern formation position on the sheet S is positioned corresponding to the first recording head 101*k*1.

At step S413, the first and second carriages 15 and 16 are separated from each other (third separation of the first and second carriages 15 and 16).

At step S414, the first carriage 15 is moved outward so that the first recording head 101*k*1 forms two reference patterns 400*a* that sandwich the measured pattern 400*b* (101*k*2-H) of the third pattern row formed at step S409 to complete formation of the third pattern row. At step S415, the first carriage 15 is moved homeward to the docking/separation position.

At step S416, the first and second carriages 15 and 16 are docked with each other (third docking of the first and second carriages 15 and 16).

At step S417, the first and second carriages 15 and 16 docked with each other are together moved outward so that the pattern detector 401 reads the measured pattern 400*b* (101*k*2-H) and the two reference patterns 400*a* on either side of the measured pattern 400*b* (101*k*2-H) of the third pattern row, and then at S418, the first and second carriages 15 and 16 are moved homeward to the docking/separation position.

As described above, in the second comparative example, the reference patterns 400*a* are formed by one of the two first recording heads offset laterally from each other in the main scanning direction, that is, the first recording head 101*k*1, provided downstream from the other one of the first recording heads, that is, the first recording head 101*k*2, in the direction of sheet feed. In such a case, docking of the first and second carriages 15 and 16, reading of the adjustment pattern 400, feeding of the sheet S, separation of the first and second carriages 15 and 16 from each other, and formation of the reference patterns 400*a* using the first recording head 101*k*1 must be performed, in that order. Consequently, the adjustment pattern 400 cannot be read by the pattern detector 401 without separation of the first and second carriages 15 and 16 from each other, thereby preventing reduction of the number of times the first and second carriages 15 and 16 are docked with and separated from each other.

A description is now given of formation and reading of the adjustment pattern 400 according to a third comparative example with reference to FIGS. 20A to 20D. FIGS. 20A to 20D are explanatory drawings illustrating steps in a process of formation and reading of the adjustment pattern 400 according to the third comparative example. In the third comparative example, the sheet S is not only fed in the single direction, that is, the sub-scanning direction, but also rewound in the middle of sheet feed.

At step 501, the first and second carriages 15 and 16 are separated from each other (first separation of the first and second carriages 15 and 16) at the docking/separation position.

At step S502, the first carriage 15 is moved outward so that the first recording head 101*k*2 forms two reference patterns 400*a* of a second pattern row at a second pattern formation position on the sheet S while the first recording heads 101*k*1 forms a measured pattern 400*b* (101*k*1-O) of a first pattern row at a first pattern formation position on the sheet S. Then, the sheet S is fed in the sub-scanning direction such that the second pattern formation position on the sheet S is positioned corresponding to the first recording heads 101*k*1.

At step S503, the first carriage 15 is moved homeward so that the first recording head 101*k*1 forms a measured pattern

400*b* (101*k*1-H) between the two reference patterns 400*a* of the second pattern row formed at step S502 to complete formation of the second pattern row while the first recording head 101*k*2 forms a measured pattern 400*b* (101*k*2-H) of a third pattern row at a third pattern formation position on the sheet S.

At S504, the first carriage 15 is moved outward so that the first recording head 101*k*2 forms two reference patterns 400*a* that sandwich the measured pattern 400*b* (101*k*2-H) of the third pattern row formed at step S503 to complete formation of the third pattern row.

At S505, the first carriage 15 is moved homeward. At this time, the sheet S is rewound in a direction opposite the direction of sheet feed, that is, the sub-scanning direction, such that the first pattern formation position on the sheet S is positioned corresponding to the first recording head 101*k*2.

At S506, the first carriage 15 is moved outward so that the first recording head 101*k*2 forms two reference patterns 400*a* that sandwich the measured pattern 400*b* (101*k*1-O) of the first pattern row formed at step S502 to complete formation of the first pattern row. Then, at S507, the first carriage 15 is moved homeward to the docking/separation position. At this time, the sheet S is fed in the sub-scanning direction such that the first pattern formation position on the sheet S is positioned corresponding to the pattern detector 401.

At step S508, the first and second carriages 15 and 16 are docked with each other (first docking of the first and second carriages 15 and 16).

At step S509, the first and second carriages 15 and 16 docked with each other are together moved outward so that the pattern detector 401 reads the measured pattern 400*b* (101*k*1-O) and the reference patterns 400*a* on either side of the measured pattern 400*b* (101*k*1-O) of the first pattern row. At step S510, the first and second carriages 15 and 16 are moved homeward. At this time, the sheet S is fed in the sub-scanning direction such that the second pattern formation position on the sheet S is positioned corresponding to the pattern detector 401.

At step S511, the first and second carriages 15 and 16 docked with each other are together moved outward so that the pattern detector 401 reads the measured pattern 400*b* (101*k*1-H) and the reference patterns 400*a* on either side of the measured pattern 400*b* (101*k*1-H) of the second pattern row. Then, at step S512, the first and second carriages 15 and 16 are moved homeward. At this time, the sheet S is fed in the sub-scanning direction such that the third pattern formation position on the sheet S is positioned corresponding to the pattern detector 401.

At step S513, the first and second carriages 15 and 16 docked with each other are together moved outward so that the pattern detector 401 reads the measured pattern 400*b* (101*k*2-H) and the reference patterns 400*a* on either side of the measured pattern 400*b* (101*k*2-H) of the third pattern row. Then, at step S514, the first and second carriages 15 and 16 are moved homeward to the docking/separation position.

As described above, the sheet S is rewound in the direction opposite the direction of sheet feed according to the third comparative example. Accordingly, the pattern detector 401 reads the adjustment patterns 400 successively after formation of all of the adjustment patterns 400 is completed, and the first and second carriages 15 and 16 need to be separated from and docked with each other only once. However, positions where the adjustment patterns 400 are formed vary due to a skew caused by rewinding of the sheet S, thereby degrading accuracy in correction of the landing positions.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2010-045337, filed on Mar. 2, 2010 in the Japan Patent Office, which is hereby incorporated herein by reference in its entirety.

What is claimed is:

1. An image forming apparatus comprising:

a first carriage movable in a main scanning direction and having at least two first recording heads offset laterally from each other to eject black liquid droplets;

a second carriage separatably dockable with the first carriage and having a second recording head to eject color liquid droplets;

a pattern forming unit to control the at least two first recording heads to form on a recording medium adjustment patterns for correcting a shift in landing positions of the liquid droplets ejected from the at least two first recording heads, the at least two first recording heads forming multiple rows of the adjustment patterns in a sub-scanning direction perpendicular to the main scanning direction, each of the adjustment patterns including at least two reference patterns and a measured pattern sandwiched by the two reference patterns aligned in the main scanning direction;

a pattern detector provided to the first carriage to read the adjustment patterns, the pattern detector successively reading at least two rows of the multiple rows of the adjustment patterns formed in the sub-scanning direction without docking and separation of the first and second carriages; and a landing position corrector to determine one of a distance between the measured pattern and at least one of the two reference patterns and a scanning time of the first carriage based on a result obtained by the pattern detector and correct the shift in the landing positions of the liquid droplets.

2. The image forming apparatus according to claim 1, wherein the pattern detector is an optical sensor.

3. The image forming apparatus according to claim 1, wherein the landing position corrector is a processor.

4. The image forming apparatus according to claim 1, wherein one of the at least two first recording heads provided upstream from the other one of the at least two first recording heads in the sub-scanning direction forms the reference patterns.

5. The image forming apparatus according to claim 1, wherein, when the first carriage scans in a single direction, one of the at least two first recording heads provided upstream from the other one of the at least two first recording heads in the sub-scanning direction forms the reference patterns and the other one of the at least two first recording heads provided downstream from the one of the at least two first recording heads in the sub-scanning direction forms the measured pattern.

6. The image forming apparatus according to claim 1, wherein the first and second carriages docked with each other are moved in a single direction from a docking/separation position of the carriages to read the adjustment patterns using the pattern detector.

7. The image forming apparatus according to claim 1, wherein the pattern detector is disposed on the first carriage at a position closer to one of the at least two first recording heads provided downstream from the other one of the at least two first recording heads in the sub-scanning direction than to the other one of the at least two first recording heads.

8. The image forming apparatus according to claim 1, wherein the recording medium on which the adjustment patterns are formed is not reversely fed upon formation and reading of the adjustment patterns.

9. The image forming apparatus according to claim 1, wherein the at least two first recording heads are disposed between the pattern detector and the second recording head in the main scanning direction.

10. The image forming apparatus according to claim 1, wherein:

only the first carriage is moved in the main scanning direction to form the adjustment patterns using the at least two first recording heads; and the first carriage is docked with the second carriage to read the adjustment patterns using the pattern detector.

11. A method for correcting a shift in landing positions of liquid droplets ejected from at least two first recording heads mounted on a first carriage movable in a main scanning direction and separatably dockable with a second carriage having a second recording head, the method comprising the steps of:

forming on a recording medium multiple rows of adjustment patterns in a sub-scanning direction perpendicular to the main scanning direction for correcting the shift in the landing positions of the liquid droplets, each of the adjustment patterns including at least two reference patterns and a measured pattern sandwiched by the two reference patterns aligned in the main scanning direction;

reading successively at least two rows of the multiple rows of the adjustment patterns formed in the sub-scanning direction using a pattern detector, without docking and separation of the first and second carriages;

determining one of a distance between the measured pattern and at least one of the two reference patterns and a scanning time of the first carriage based on a result obtained by the reading; and correcting the shift in the landing positions of the liquid droplets based on the determined distance or determined scanning time.

* * * * *